US005564235A

United States Patent [19]

Butler

[11] Patent Number: 5,564,235

[45] Date of Patent: Oct. 15, 1996

[54] FOUNDATION AND FLOOR CONSTRUCTION MEANS

[76] Inventor: Michael Butler, 31078 Turner Rd., Fort Bragg, Calif. 95437

[21] Appl. No.: 299,474

[22] Filed: Aug. 29, 1994

[51] Int. Cl.[6] ..... E02D 27/00; E04B 5/10; E04B 5/17

[52] U.S. Cl. ..... 52/126.6; 52/263; 52/294; 52/299; 52/650.3; 52/742.14; 249/4; 249/6; 249/18; 249/210; 16/260

[58] Field of Search ..... 52/29, 294, 263, 52/126.6, 650.3; 249/3, 4, 5, 6, 7, 18, 207, 210; 403/300, 301, 303, 311; 16/260, 267, 268, 269, 271, 742.14

[56] References Cited

U.S. PATENT DOCUMENTS

| | | | |
|---|---|---|---|
| 1,576,846 | 3/1926 | Pomfret | 249/210 X |
| 1,897,530 | 2/1933 | Pandolfi | 249/4 |
| 3,826,460 | 7/1974 | Cast | 249/210 X |
| 3,977,536 | 8/1976 | Moore et al. | 249/18 X |
| 4,142,705 | 3/1979 | Miller | 249/210 X |
| 4,202,145 | 5/1980 | Coulter et al. | 52/294 X |
| 4,451,022 | 5/1984 | Sauger | 249/4 X |
| 4,930,278 | 6/1990 | Staresina et al. | 52/602 X |
| 5,343,667 | 9/1994 | Peden | 52/699 |
| 5,402,614 | 4/1995 | Jewell | 52/299 |

FOREIGN PATENT DOCUMENTS

| | | | |
|---|---|---|---|
| 1145179 | 4/1983 | Canada | 249/210 |
| 2829249 | 1/1980 | Germany | 52/263 |
| 6-57761 | 3/1994 | Japan | 52/294 |
| 6-116966 | 4/1994 | Japan | 52/294 |
| 6-180063 | 6/1994 | Japan | 249/18 |
| 293955 | 1/1954 | Switzerland | 52/263 |

OTHER PUBLICATIONS

"Slabmaker I Adjustable Slab on Grade Form System", Medalist Forming Systems Brochure 2 pages, 1986.

dee Steel Forms Advertisment, Concrete Construction, Oct. 1994, p. 818.

Metaforms Advertisment, Concrete Construction, Oct. 1994, p. 822.

*Primary Examiner*—Carl D. Friedman
*Assistant Examiner*—Laura A. Saladino
*Attorney, Agent, or Firm*—William C. Fuess

[57] ABSTRACT

A foundation structure comprises a plurality of light metal parts which assemble and secure in place prior to placement of foundation in situ concrete. Assemblage is supported by coarsely threaded rods which screw directly into earth and attach to parts by various methods. Some parts remain in place as permanent supporting members for superimposed structure. Others, which generally form surfaces of foundation concrete, subsequently relocate to become either similar permanent structural members, or inventory for subsequent projects. Use of a computer aided design program assists in optimal configuration of parts, and creates a list of parts with necessary cut and piecemark information for automated fabrication of any particular length parts. This information, along with a computer produced schematic plan, allows use of parts as collocation elements which define a distinct foundation design by simple field assembly. Variations in assemblage of parts accommodate requirements of site, user needs, and materials of subsequent structure. Specific versions offer an integral joist floor structure, a free standing wall, or a concrete slab on grade. Interface with subsequently superimposed walls is specific to those of either framed members, or concrete type materials.

29 Claims, 17 Drawing Sheets

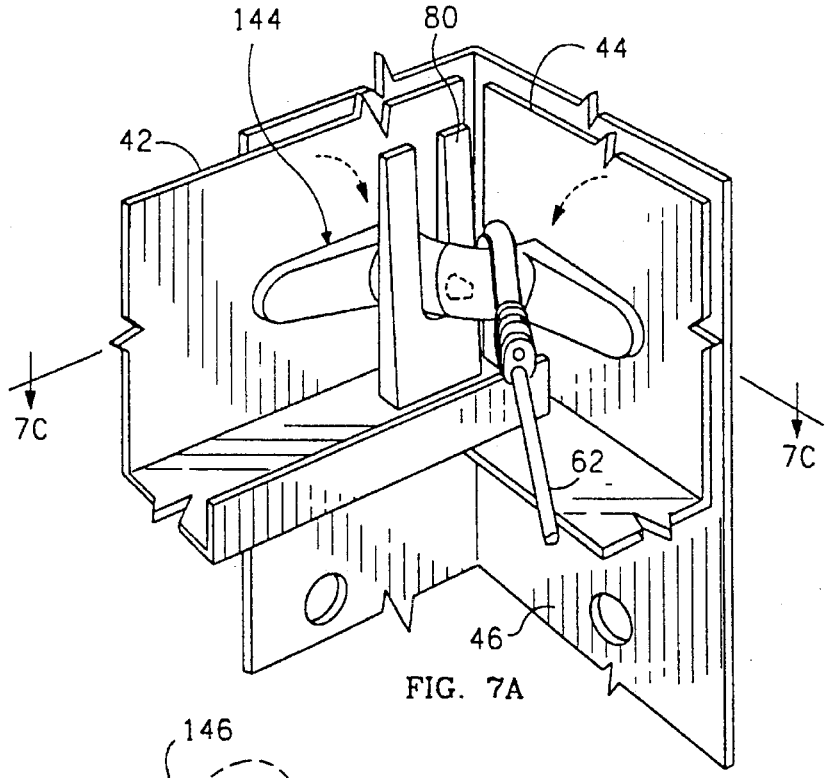
FIG. 7A
FIG. 7B
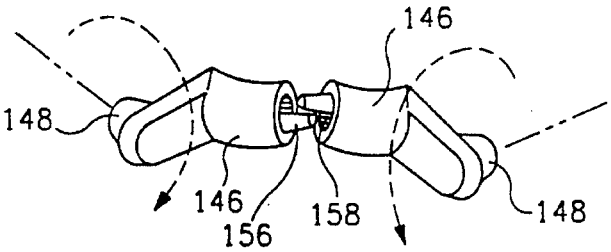
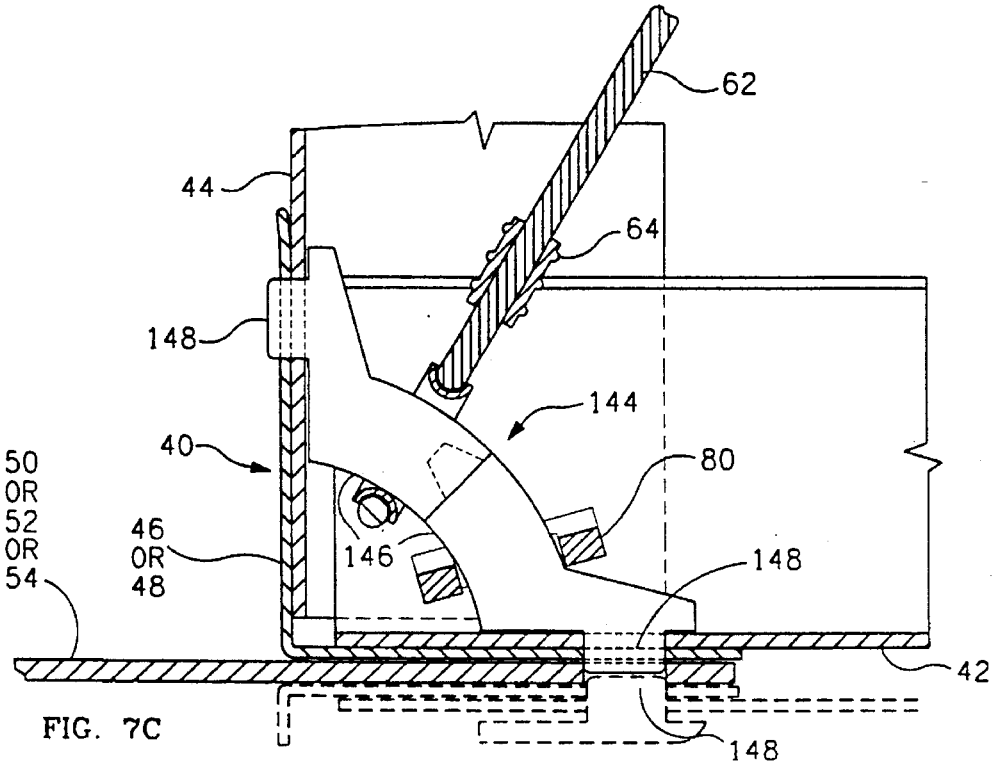
FIG. 7C

FIG. 8A
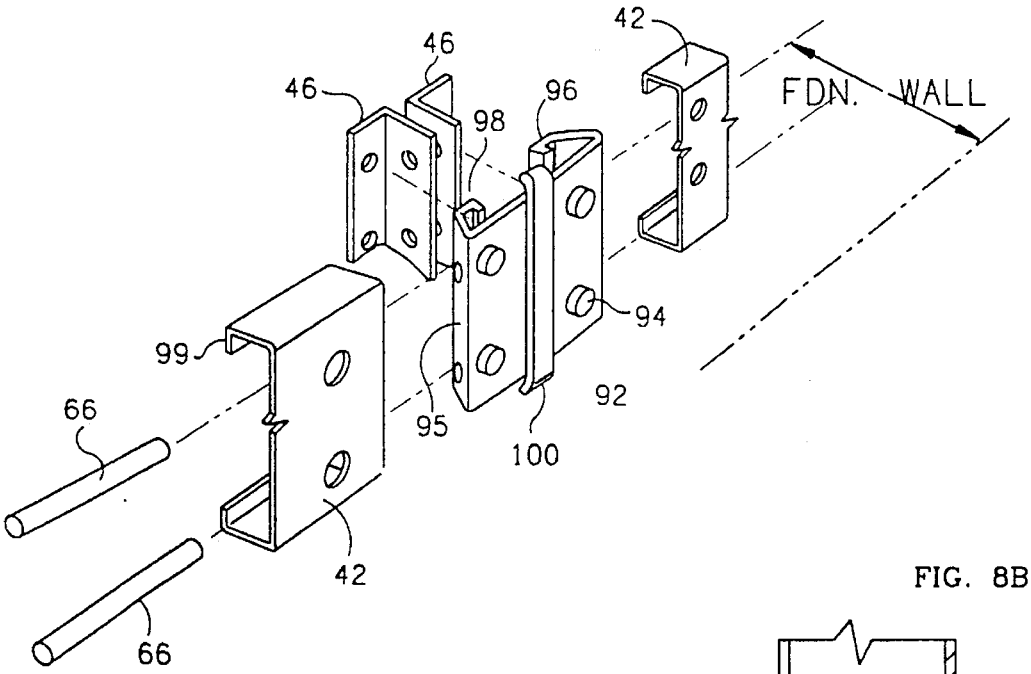
FIG. 8B
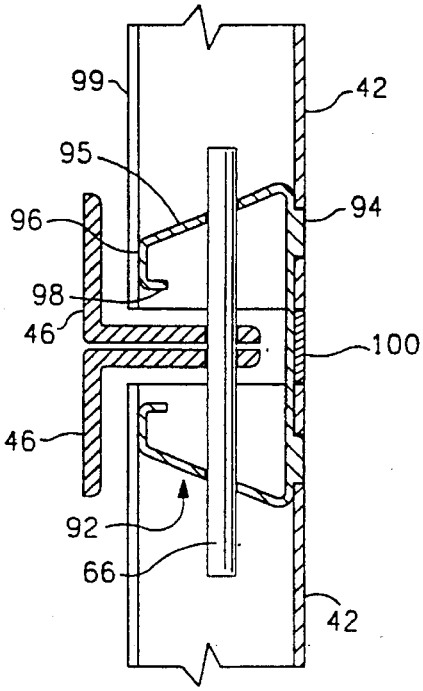
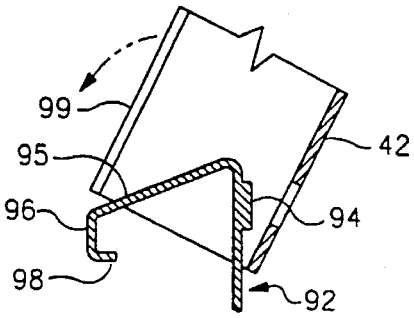
FIG. 8C
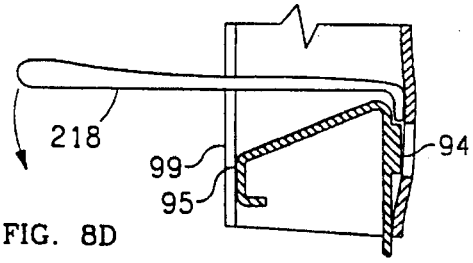
FIG. 8D

FIG. 9A
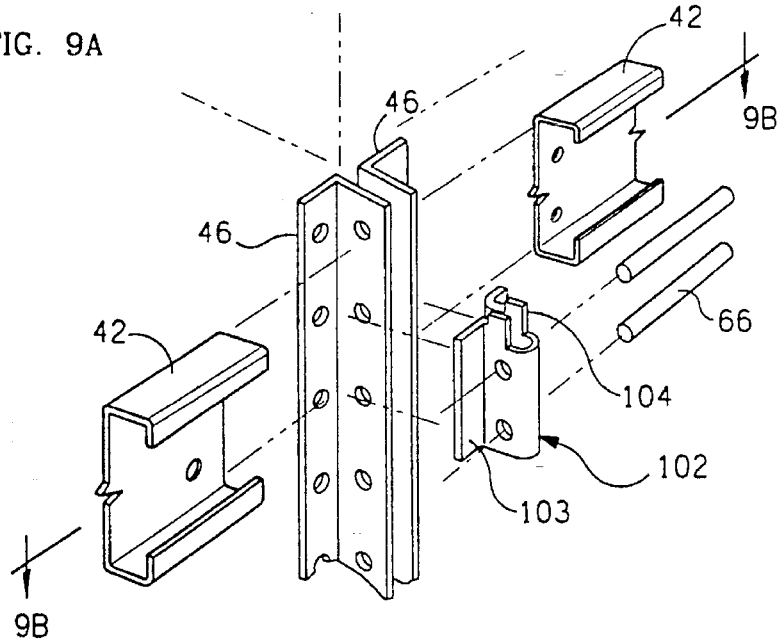
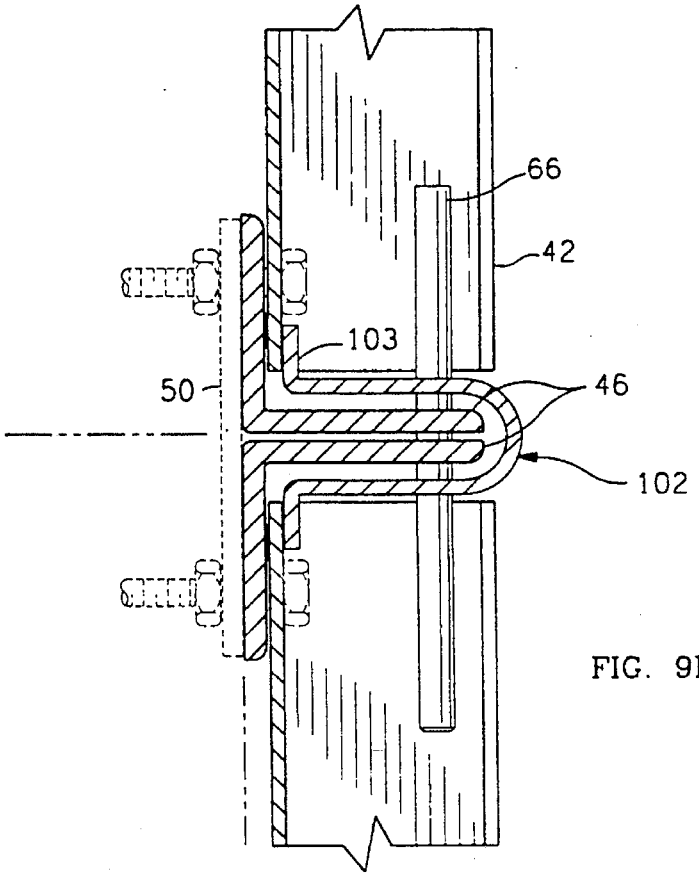
FIG. 9B

FIG. 11
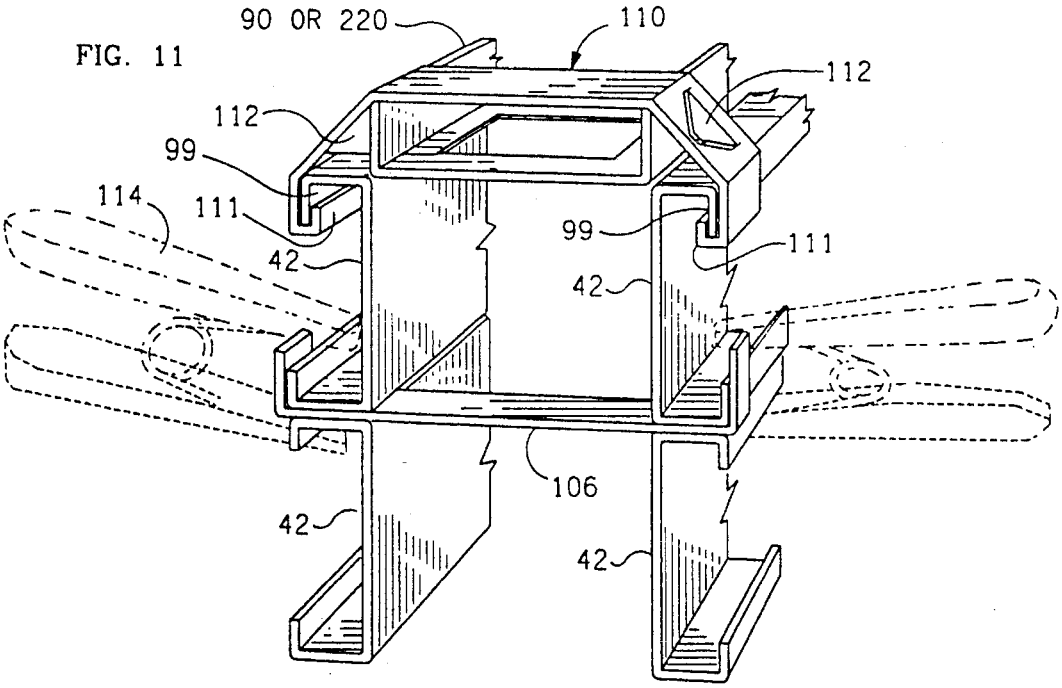
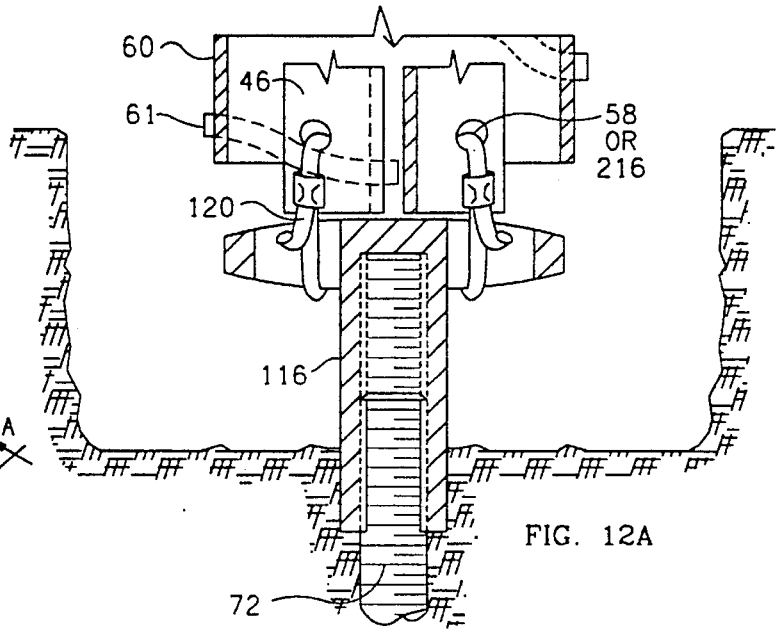
FIG. 12A
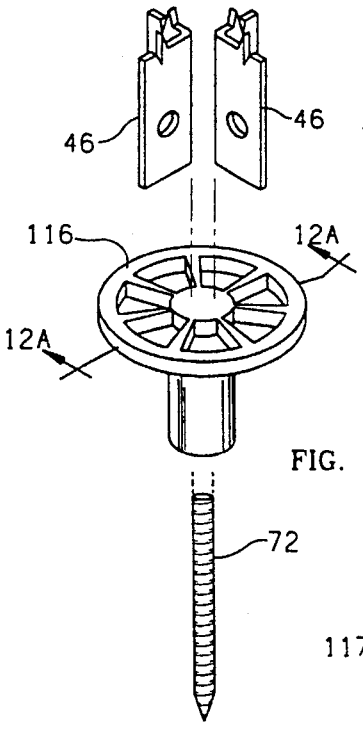
FIG. 12B
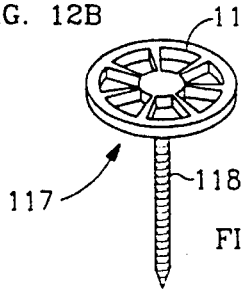
FIG. 12C

FOUNDATION AND FLOOR CONSTRUCTION MEANS

BACKGROUND

1. Field of the Invention

This invention involves a means of constructing a foundation and floor which provides improvement over existing practices.

2. Prior Art

Foundation construction practices share common challenges world wide. Relative to the requirements of a structure, a building site must be considered a random surface. This randomness must be interrelated to an orthogonal grid upon which the remainder of the structure is referenced and built to. Thus, building a foundation involves a process, such as building forms for in situ concrete, requiring the locating of many points in three dimensional space. A random earth surface serves as the basis for any structure required to remain at these points. Work involving the measuring must be done carefully. Skilled, and therefore expensive labor is essential. Irregular terrain or mucky ground surface slows progress of work. Bad weather may stop it altogether.

A concrete foundation requires that forms be built and secured so that they will not dislocate as concrete, weighing 140 pounds per cubic foot, is placed into them. Part of the foundation construction may also be sculpting the earth surface to conform to the building grid, such as would be done for a concrete slab on grade. However, user requirements, site conditions or equipment costs often dictate the use of foundation walls with a raised floor in lieu of, or in conjunction with, any slab on grade.

Conventionally, concrete is placed before any structure which is to be above it. Commonly the foundation is built by a different party than those building the superimposed structure. Thus the foundation crew has less motivation to be careful with time consuming checks, such as squareness of corners, than the subsequent construction crews would like. Once concrete has set, it is very difficult to fix any dimensional errors or misplaced hardware. Skilled labor is consumed in measuring an as-built foundation. Labor and management time is subsequently consumed in dealing with any error. Even with the best of intentions, a foundation may turn out to be inaccurate due to miserable site conditions. It is difficult work.

Some construction materials recently gaining acceptance, such as steel stud framing, are much less accommodating of normal surface irregularities in concrete than wood framing is. Because of this, many hours of labor are spent fussing with cuts of metal studs that frame to the top of a foundation wall.

In custom foundation construction, many hours are spent on such things as: Building multiple batter structures to secure guide strings; attempting to re-square sets of those strings while they quiver in the wind, with that squaring process depending upon floating points of intersection; or adjusting superimposed structural framing to suit an inaccurately built foundation. There are many time consuming problems in foundation construction, and the potential for improvement is enormous.

An object of this invention is to build a higher quality foundation for less cost than conventional methods allow.

This new means of construction quickly secures permanent structural members accurately into position before any concrete is placed. The resulting structural assembly also supports any concrete forms. Walls are physically defined, automatically, according to the layout of a user directed computer aided drawing.

This means of constructing a foundation allows inexpensive, one dimensional computer aided manufacturing technology to replace field labor. It utilizes standard sections of cold formed gage steel, with distribution currently established and improving, to replace a diminishing supply of wood members, as they are commonly used. This set of metal members, of standard and custom lengths, make up a kit which is self squaring as it is rapidly assembled to exactly the right dimensions and at the proper elevation.

This means constructs a foundation which has a floor of metal joists, or of a concrete slab on grade. Subsequently placed walls may be of any material. Defining elements of walls may be secured in place and cast with in situ concrete.

Reasons for a building contractor to utilize this method of building a custom foundation include the following:

A) Save significantly on field labor costs
  1) Less labor required
  2) Less skill required
B) Save on site grading costs
  1) Building pad creation or compaction not required
  2) Infringe code required crawl space clearances for wood
C) Save on labor attaching superimposed wall framing
  1) Designed specifically to accept metal framed walls
    a) Set into place without any fuss
    b) Cast into place parts as desired
  2) Designed specifically for walls of concrete material
  3) Any other wall material may be used as well
D) Reduce Contractor's inventory costs
  1) Metal foundation wall forms are used as floor joists
  2) Standardized, durable, low cost, interchangeable parts
E) Build a higher quality foundation
  1) More accurate and consistent
  2) No vegetable matter to decay
  3) Attractive surface pattern on concrete walls
F) Appropriate range of adaptation
  1) Variation of site
  2) User requirements
G) Easy availability
  1) Distribution established by AISI member manufacturers (American Iron and Steel Institute)
H) Rapid completion
  1) Allows tight schedules
  2) Fits narrow weather windows
I) Suits low income housing projects
J) Suits prefabricated projects
K) Consistent reliability of performance Labor is saved initially due to the fact that this method avoids the need to set up batterboard structures and strings to define foundation edges. Only one string need be set. The previously required, lower accuracy layout for footings may be done by any method, such as tape measuring and marking earth immediately before a backhoe cuts any trench.

Labor is further saved by the fact that no field cutting of horizontal members is required. Prepunched holes in members of controlled lengths, combined with snap in connections, facilitate rapid assembly of a self squaring structure. These lengths may be modular or special, as determined by the software that also determines CNC output, piece marking, and packaging.

No fitting of structural elements to irregular, hardened concrete is ever necessary. Members may be cast in situ, or a new tool may be used to work a flat, accurate concrete surface within tolerance required of metal studs. Anchor bolts are not required, nor is the time consuming process of locating penetrations in a sill framing member for those bolts.

Since cost of a joisted floor is thereby lowered, many projects will save in using this over a slab on grade, because of equipment costs involved in preparing a site for those slabs. The typical home owner prefers a joisted floor because of the cushioning spring action, and because underfloor electrical, plumbing, or mechanical modifications are possible. The building contractor likes being able to sell the wall forms to the job as floor joists.

An insulated decking over metal joists, which combines with a radiant heat floor slab, is a standard deployment of this construction. This avoids the need to install underfloor insulation. It also avoids any need for a plywood type product which has potential to rot.

All parts for this structural system are inexpensive. Interchangability is maximized. After concrete placement, foundation wall form members simply unsnap from the wall face and connect into girders at prelocated, prepunched holes. Lengths of these members need not be adjusted for this switch from form to joist, even at end bays of a custom length. The same holes find mating elements for either use. The software does all the hard work.

The cold formed joist members have a far higher standard of quality control and straightness than does wood. The metal forms fare much better than wood if they are required for multiple form uses. The standard edge radius of these stacked members produces an attractive pattern on the concrete surface. Any surface effects at form connection locations are hardly noticeable.

Since no vegetable material is required in this construction, concerns about rot and termites are not required either. Crawl spaces may be shallower than codes require for wood. Crawl space vents, which can lose precious heat in the winter, may be minimized or omitted, because building codes require crawl space ventilation specifically to avoid rot in wood members.

Any reasonable building site is appropriate for this means of construction. The main floor elevation may be well above or below exterior grade. Any horizontal dimension may be met. Vertical dimensions between steps in floor height are in small modules. Stemwall height may be at any such relative modular increment, below, at, or above floor framing. Retaining walls may be integral with this assembly.

Since a level working platform may be erected quickly, other aspects of construction are facilitated sooner. The critical period of a foundation site being cut open and most vulnerable to weather is minimized. Concrete can be placed the same day trenches are dug.

By use of this invention, a better foundation and floor structure may be built at a lower cost than is possible with current practices for custom buildings.

DRAWING FIGURES

FIGS. 1 and 1A A complete Structural Grid Assembly for the foundation of a residence (method A1 of method outline, described below), prior to placing any foundation concrete.

FIGS. 2 and 2A The same foundation of FIGS. 1 and 1A, after concrete is placed, and Joist/Forms have been moved from form to joist mode.

FIG. 3 One Module of a beginning bay having diagonal ties and some attachments (per version A1 of method outline, described below).

FIGS. 3A–3B Post Assembly

FIGS. 4A–4E Threaded Stake Support Assembly

FIG. 5 Joist/Form and Girder Element

FIGS. 6A–6B Track, cast in place

FIGS. 7A–7C Over Center Collocator

FIGS. 8A–8D Connecting Cap

FIGS. 9A–9B Omega Clip

FIGS. 10A–10D Various collocating elements

FIG. 11 Hang Tie, Tie

FIGS. 12A–12C Adjustable Support

FIGS. 13 Rebar Plug

FIGS. 14A–14B Twister, for driving and removing threaded stakes

FIGS. 15A–15B Insulating Decking Panel

FIGS. 16A–16B Gusset Anchor and Shear Anchor

FIG. 17 Section at perimeter of joisted floor with framed wall (version A1 of method outline, described below) before concrete. The top of concrete (TOC) may be below, at, or above floor framing, by any modular (floor framing height) distance.

FIG. 18 Section at perimeter of joisted floor with concrete type material wall (version A2 of method outline) before concrete. The top of concrete (TOC) may be below, at, or above floor framing, by any modular framing height) distance.

FIG. 19 Section at perimeter of slab on grade or ponywall with framed wall (version B1 of method outline) before concrete.

FIG. 20 Section at perimeter of slab on grade with concrete type material wall (version B2 of method outline) before concrete.

Reference Numerals in Drawings

| | |
|---|---|
| 40 Module | 42 Joist/Form |
| 44 Girder Element | 46 Post Element |
| 48 Clip | 50 Link Plate |
| 52 Cantilever Plate | 54 Ledge Plate |
| 56 Ledge | 58 Reinforcing Bar |
| 60 Column Form | 61 Helical Reinforcing |
| 62 Diagonal Tie | 64 Wire Clamping Device |
| 66 Aligning Pin | 70 Threaded Stake Support Assembly |
| 72 Threaded Stake | 74 Nut |
| 78 Clamping Bar | 80 Forked Wedge |
| 82 Kicker Hinge | 84 Coupler |
| 86 Track | 87 Punchout |
| 88 String | 90 Guide Track |
| 91 Hole | 92 Connecting Cap |
| 94 Stud Element | 95 Sloped flange |
| 96 Pressure lip | 98 Stiffening lip |
| 99 Stiffening lip | 100 Flush Face element |
| 102 Omega Clip | 103 Spring flange |
| 104 Collocating tab | 105 Corner Piece |
| 106 Form Tie | 110 Hang Tie |
| 111 Hang Tie hook | 112 Squaring tab |
| 114 Spring Clamp | 116 Adjustable Support |
| 117 Integral Adjst. Support | 118 Threaded shaft element |
| 119 Pad element | 120 Plastic loop tie |
| 124 Gusset Anchor | 125 Brace tie |
| 127 Outer leg | 130 Rebar Plug |
| 131 Eccentric Rebar Plug | 132 Rebar Plug half |
| 134 Locking Ring | 135 Lower projection |
| 136 Flange | 137 Flange lip |
| 138 Upper body | 139 Rib |
| 140 Lip | 142 Seat |
| 144 Over-Center Collocator | 146 Mating half |
| 148 Stud element | 150 Arm |
| 152 Engagement end | 154 Seat |

-continued

| Reference Numerals in Drawings | |
|---|---|
| 156 Alignment tab | 178 Alignment recess |
| 159 Insulating Deck Panel | 160 Foam core |
| 161 Structural membrane | 162 Tongue edge |
| 163 Groove edge | 164 Screw fastener |
| 165 Very broad head | 166 Heat pipe |
| 188 Twister | 190 Shaft |
| 192 Flange of shaft | 194 Wire coil |
| 196 Twist Cover | 198 Friction Tab |
| 216 Threaded stud | 218 Prying tool |
| 220 Cast Track | 222 Anchoring tab |
| 224 Stiffening lip | 226 Supporting ear |
| 230 Framing member | |

DESCRIPTION OF THE PREFERRED EMBODIMENT

Figure 1:
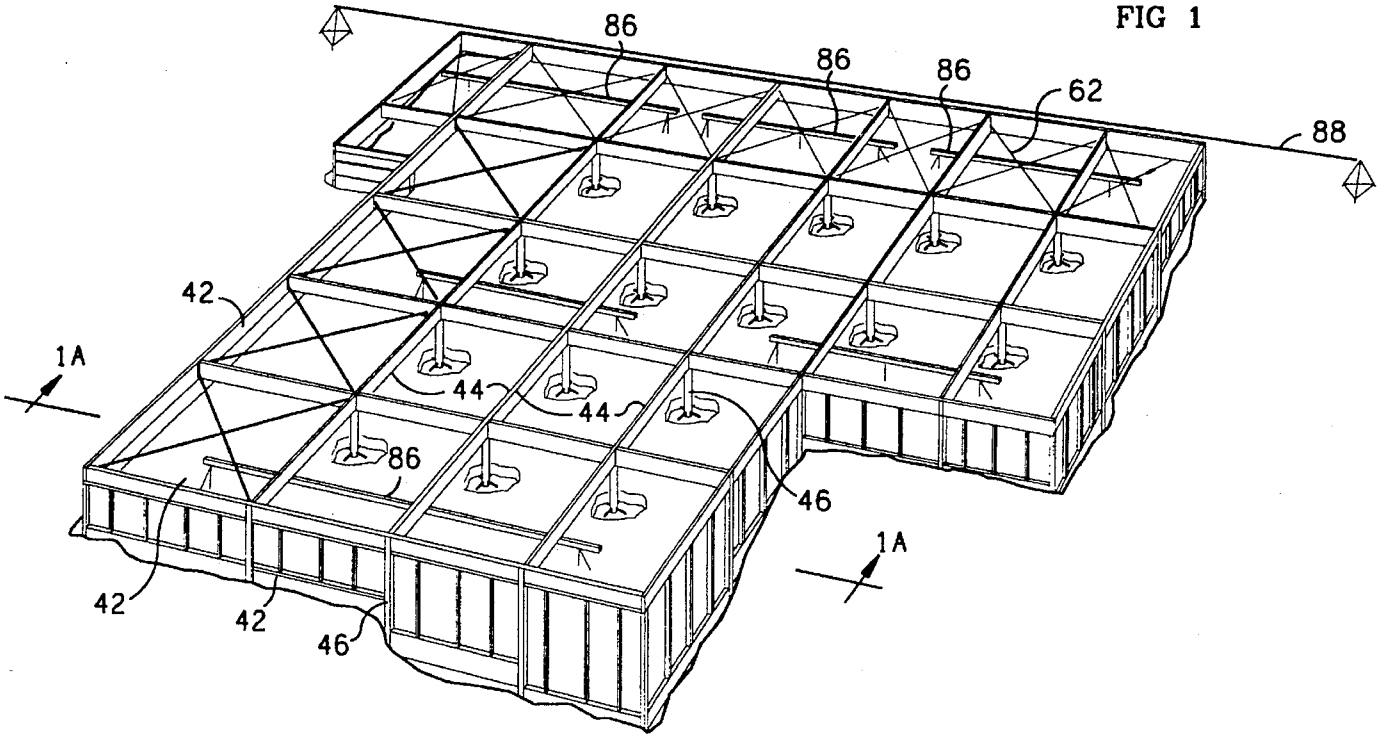

An overview of the foundation and floor construction means of the present invention may be considered to be as follows.

This foundation and floor construction means takes on various versions to suit the needs of site circumstances and user requirements. Since elements of this means may deploy in multiple versions, distinctions are somewhat blurred. However, a rough outline of the methods may be construed as follows:

An outline of the method of constructing a foundation and floor in accordance with the present invention may be considered to be as follows.

Threaded Stake Support Assembly (universal to all versions)

A. Squared Module Collocator (metal floor joists)
   1. Framed Walls (generally multiple stud members)
   2. Concrete Material Walls (shotcrete, block, etc.)

B. Channel Member Collocator (no floor joists)
   1. Framed Walls (generally multiple stud members)
   2. Concrete Material Walls (shotcrete, block, etc.)

For this foundation construction means, a computer aided drawing must first be prepared. Software, which is an essential element of this means, is superimposed over a common computer drafting program. This software generates drawing information according to specifications of this construction method. Decisions, such as that about which bay to begin foundation assembly with, are made at this point. A schematic foundation and floor framing plan is produced. This plan has piecemarks indicated that match those of pieces fabricated at lengths determined by this software. A package of parts is site delivered with the schematic plan.

The horizontally oriented structural members of this assemblage are standard cold formed gage steel sections, per American Iron and Steel Institute specifications, produced from coil steel, generally electro-galvanized, as are conventionally used in construction. For this method, established benefits of framing members which nest, are combined with various non-conventional punchouts allowing new methods of use. These members are precut and prepunched to accept new types of connection elements. Standardized lengths and punchout locations are used whenever optimal, but may be adjusted to suit any geometry, according to input and output of this software.

The vertically oriented structural members are similar to existing light steel utility angles having holes punched at regular intervals. These members are generally cut to length in the field, after site preparation, where necessary information of topography is immediately available. These cuts are made midway between any two connection holes by use of a collocating fixture attached to a power saw.

The various connection pieces herein are generally of heavy gage steel. They enable new means of attaching, and therefore utilizing, these horizontal and vertical members. Principles of these methods work with any thin walled material. This would typically be parts and members of galvanized sheet steel, but alternatively could be of thin plastic.

The specific parts of the foundation and floor construction means of the present invention may be best observed in FIGS. 3–16.

A module 40 (FIG. 3) is made up of: two of a joist/form 42, and two of a girder element 44. Module 40' at a beginning bay also has two of a diagonal tie 62, a wire of specific length between terminal eyes.

A post element 46 is a light galvanized steel angle member having connection holes at regular intervals along each flange. A clip 48 is a short length of post element 46 material. The column strength of a post assemblage may be increased with concrete by use of a column form 60, of light flexible vinyl, which has steel helical reinforcing 61. It is a larger and heavier version of dryer vent hose. Helical reinforcing 61 compresses and expands pitch allowing form 60 to adjust length for ease of installation, and provides permanent structural confinement for resulting concrete column.

A track 86 is a channel section similar to girder element 44, but has a series of a relatively large hole 87 for adjustable attachments. Alternatively, a track 86' may be a C-section similar to joist/form 42, having standard punchouts as are commonly used for metal framing stud members.

A corner piece 105 forms corners of foundation walls, and is removed for later re-use. It is of the same section and connection means as joist/form 42, and may be made specifically for corners which are at other than 90 degrees.

A threaded stake 72 (FIG. 4) is a coarsely threaded steel rod. It may be varied in length, and has a tapered lower end. It may have a hex head for driving purposes. Or, a simple cut end, in combination with a driving device (which is described below), may be used.

A nut 74 provides connection means. To speed up adjustment of nut 74 along threaded stake 72, a motorized cylindrical device which rubs against nut 74 may be used. Alternatively, threaded knobs having a capacity to disengage threads by a tilting action, and thereby slide along threaded stake 72, may be used.

A clamping bar 78 is a small square bar section of steel formed into a U shape. A forked wedge 80 is a steel wedge with a slot at the thinner end. A kicker hinge 82 is a door hinge with a slot on each leg. Each of these parts inserts onto threaded stake 72.

Joist/form 42 (FIG. 5) is a planar member comprising a galvanized cold formed steel C-section having specific connection holes at each end. Girder element 44 is a similar steel channel section which is formed to nest over a mating C-section, and has specific connection holes at each end and along its length.

A cast track 220 (FIG. 6) is a galvanized cold formed steel channel section which is cast with in situ concrete. It has a series of an anchoring tab 222 punched and folded out of the web, creating a series of a punchout 87 for access to concrete form space. Anchoring tab 222 has a pair of a stiffening lip 224 which provides strength, and a pair of a supporting ear 226 which is used to support a length of a reinforcing bar 58.

An over-center collocator 144 (FIG. 7) consists of a pair of a flexible, high-density-polyethylene plastic mating half 146. Each half 146 is identical to the other, and has a stud element 148 which fits holes punched in various cold formed steel members.

A connecting cap 92 (FIG. 8) is a part means comprising a folded sheet metal part sized to fit within the web and flange lip 99 of a joist/form 42. It utilizes spring action of a sloped flange 95 and a pressure lip 96, in combination with elastic deformation of joist/form face, to allow clearance required for fit. Stud element 94 is fabricated by a stamping process, or alternately, may be an attached, short rod section. A flush face element 100 is of a portion of a section of joist/form 42, and is adhered onto the face of connecting cap 92. An aligning pin 66 is a piece of steel rod. Alternatively it may be a bolt.

An omega clip 102 (FIG. 9) is a folded sheet metal part which has two of a spring flange 103 which is a specific distance from two holes which receive aligning pin 66. Collocating tab 104 is a simple extension of sheet metal.

A link plate 50 (FIG. 10), a cantilever plate 52, and a ledge plate 54 are planar elements, all of heavy gage sheet metal. Ledge plate 54 has one or two of a supporting ledge 56 which has collocating holes made to receive a rebar plug 130, described below.

A hang tie 110 (FIG. 11) is of relatively heavy gage folded sheet metal, and is reusable. This allows a hang tie hook 111 to have necessary strength. A squaring tab 112 is punched and folded out of main body.

A form tie 106 is made from a slice of a standard cold formed steel track section. Alternatively, it could be of copper or another non-corrosive material. Since form tie 106 is not used for collocation, and therefore has no compression strength requirement; it may be very light, and it requires no longitudinal stiffening fold.

An adjustable support 116 (FIG. 12) is a low cost, polyethylene plastic device which screws onto threaded stake 72 which has been screwed into earth. For this application, threaded stake 72 may alternatively be of a non-corrosive, dense reinforced plastic. An integral adjustable support 117 combines a threaded shaft element 118 with a pad element 119, and is of dense reinforced plastic.

Rebar plug 130 (FIG. 13) is two of an identical mating rebar plug half 132 of flexible polyethylene plastic. A pattern of a rib 139 on the inside of an upper body 138 meshes with the pattern of ribs as are found on conventional reinforcing bar for in situ concrete. Each half 132 is secured to the other by a steel locking ring 134. A lip at the end of a lower projection 135 secures rebar plug 130 into a hole. A flexible flange 136 spans enough distance to a bearing flange lip 137 allowing a secure enough fit over one or multiple laminations of metal.

An eccentric rebar plug 131 has the features of rebar plug 130, except that upper body 138 holds reinforcing bar off center of lower projection 135. This allows adjustment in reinforcing bar 58 location, relative to concrete surface, to be made by rotation of eccentric rebar plug 131, providing opportunity to avoid interference with other reinforcing elements.

A twister 188 (FIG. 14) is a metal tool for driving and removing threaded rod 72. It consists of a shaft 190 with a flange 192 which is connected to an upper end of a wire coil 194, and a twist cover 196 which connects to a lower end of same wire coil 194. Twist cover has a series of a friction tab 198 which provides friction against knurled edge of flange 192, allowing a sustained torsional strain on wire coil 194, which creates a clamping action onto inserted threaded stake 72.

An insulating deck panel 159 (FIG. 15) is of a high density rigid polystyrene foam. It has a structural membrane 161 adhered to faces and edges to provide protection and strength, making it possible to handle panels, walk on them, and place a concrete layer over them. Membrane 161 on faces provides flexure strength, and on edges provides laminar shear strength. A tongue edge 162 mates an adjacent panel 159 groove edge 163.

A fastener 164 may be set tightly enough to secure panel 160 without damage to foam, because of a very broad head 165. Very broad head 165 also provides direct support to superimposed concrete slab. This allows for greater load capacity onto a slab which is placed upon spanning foam panels.

A gusset anchor 124 and a shear anchor 126 (FIG. 16) are each of folded sheet metal. The bottom portion of each, which is cast into in situ concrete, has large holes allowing continuity of concrete. They are each of a size to clear superimposed wall framing which they attach to.

OPERATION FIGS. 1–20

The following assembly description is generally for a joisted floor, version A of method outline, unless noted otherwise. For all versions, essential elements of structure are assembled in place prior to placement of any concrete.

After equipment has prepared the building site for footings, erection of foundation structure can begin.

The first step (FIG. 1) is to set up a string line 88 along one edge of a bay where assembly will begin. A pair of temporary supporting tracks 86 are erected along this bay, using threaded stake support assemblies 70. Exact location of tracks 86 is unimportant, only elevation matters. A number of modules 40, will assemble in place on these tracks 86, and remain there permanently. The same erection process is followed along an appropriate perpendicular bay.

While it may be preferable for modules 40 to all be identical and square, many are of custom dimension and rectangular (or even triangular with some modification), in order to suit architectural needs. The software helps to choose a geometrical arrangement that is the most efficient in use of materials and labor.

At any time during or after the assembly along tracks 86, elements elsewhere in the field, or along the perimeter, may be assembled. Post 46 support occurs at every module intersection (grid), and also at the intersection of any grid the perimeter forms. Walls, below and above the floor structure, are physically defined as this assembly progresses.

Figure 2:
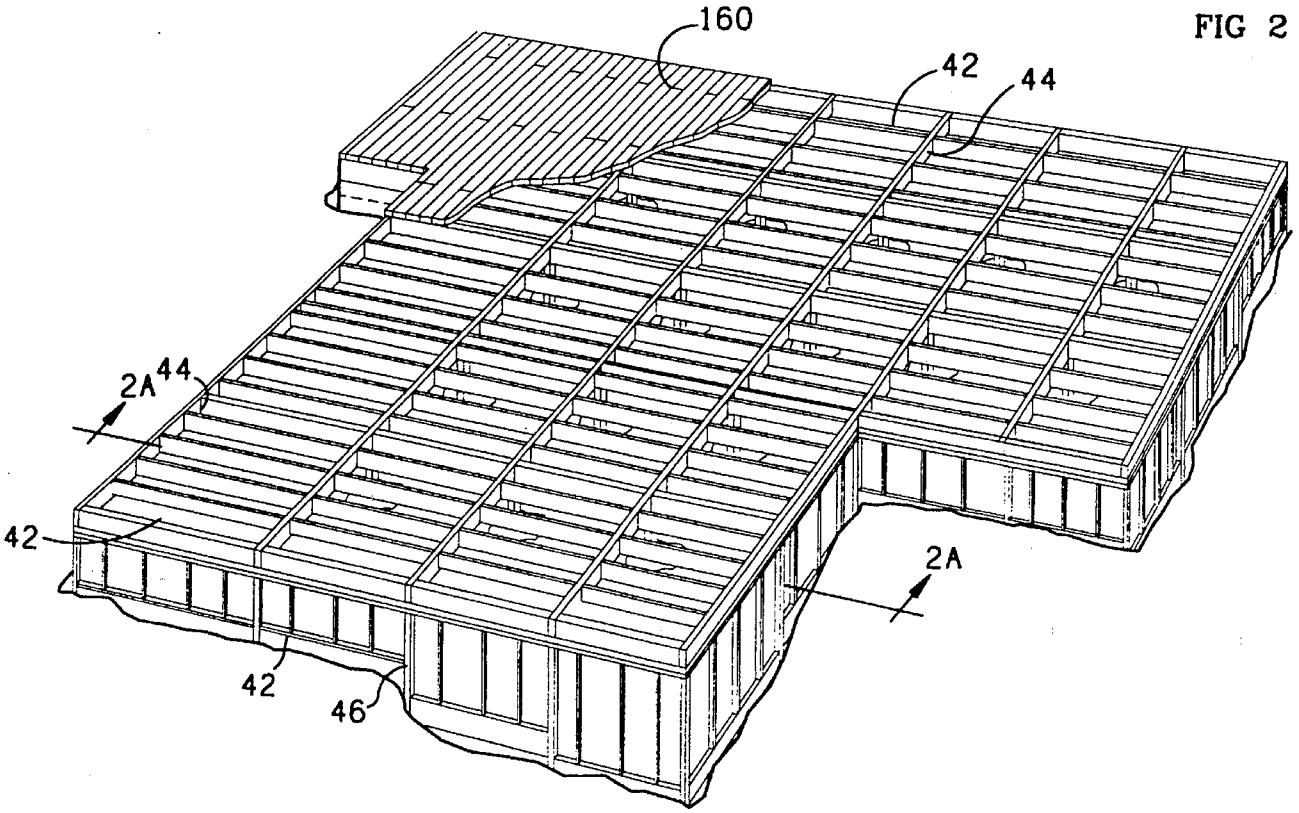
Figure 2A:
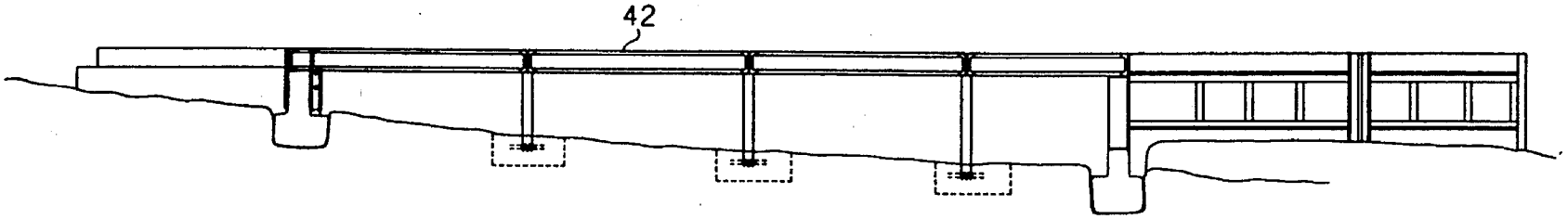
Figure 3:
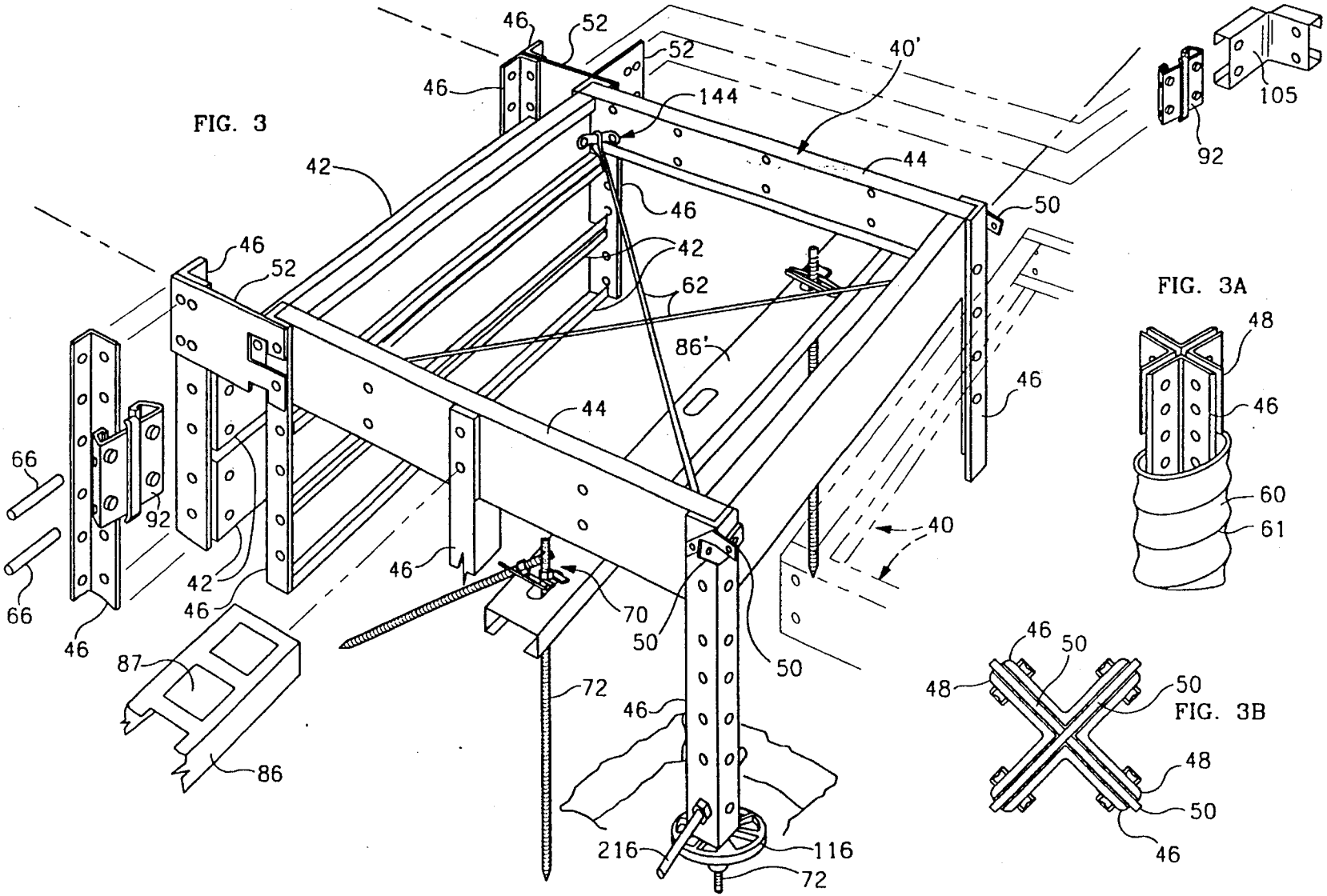
Figure 4A:
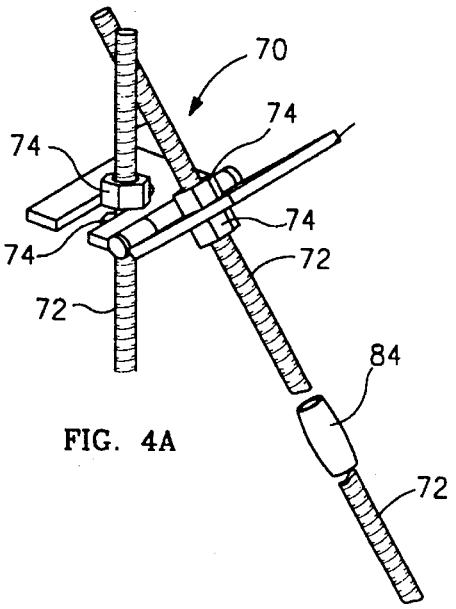
Figure 4B:
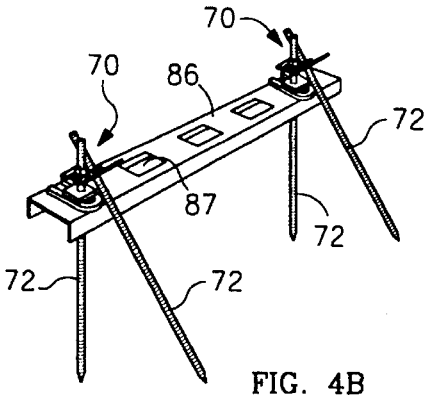
Figure 4C:
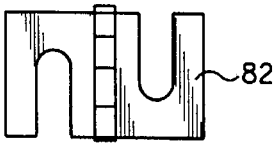
Figure 4E:
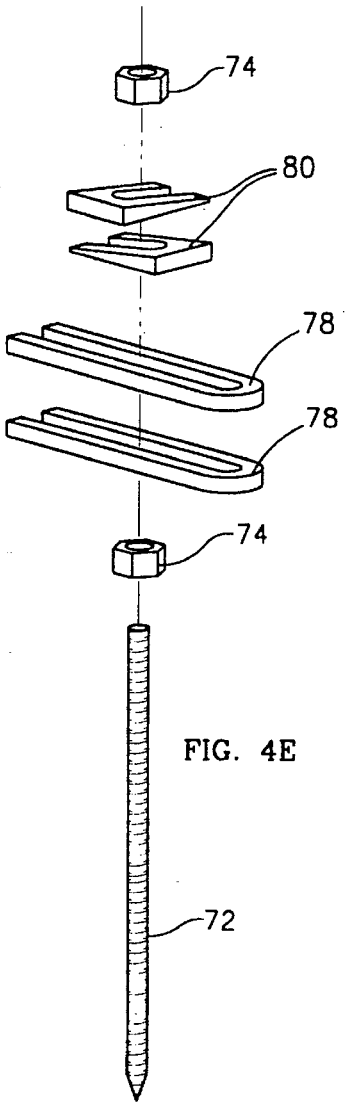
Figure 4D:
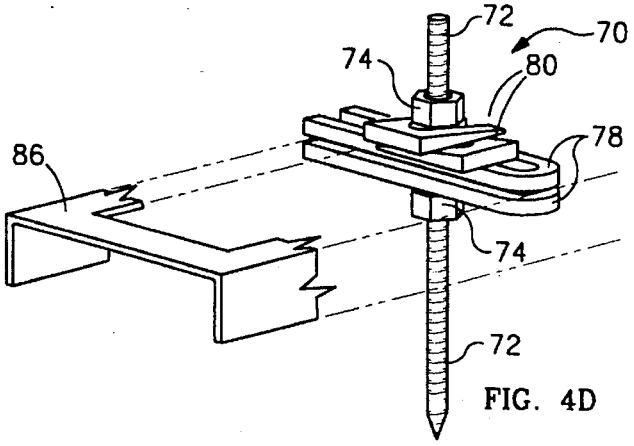
Figure 5:
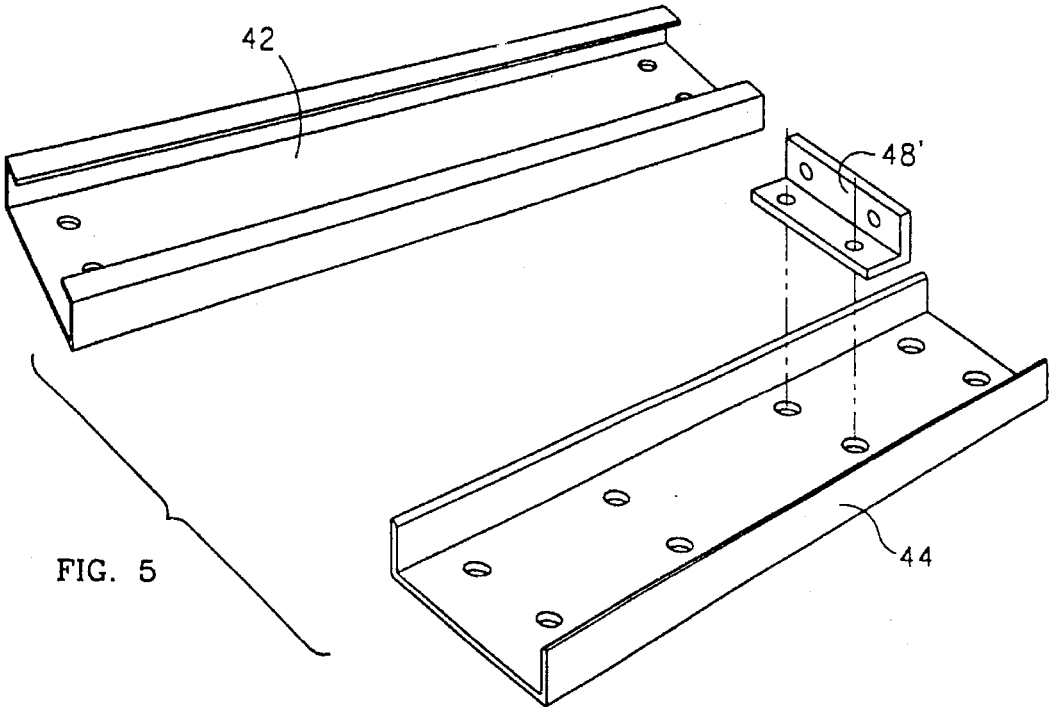
Figure 6A:
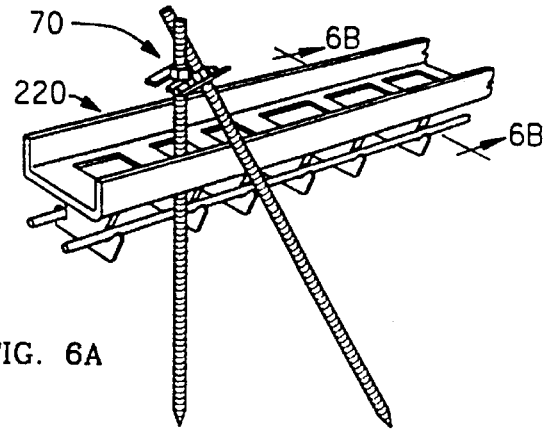
Figure 6B:
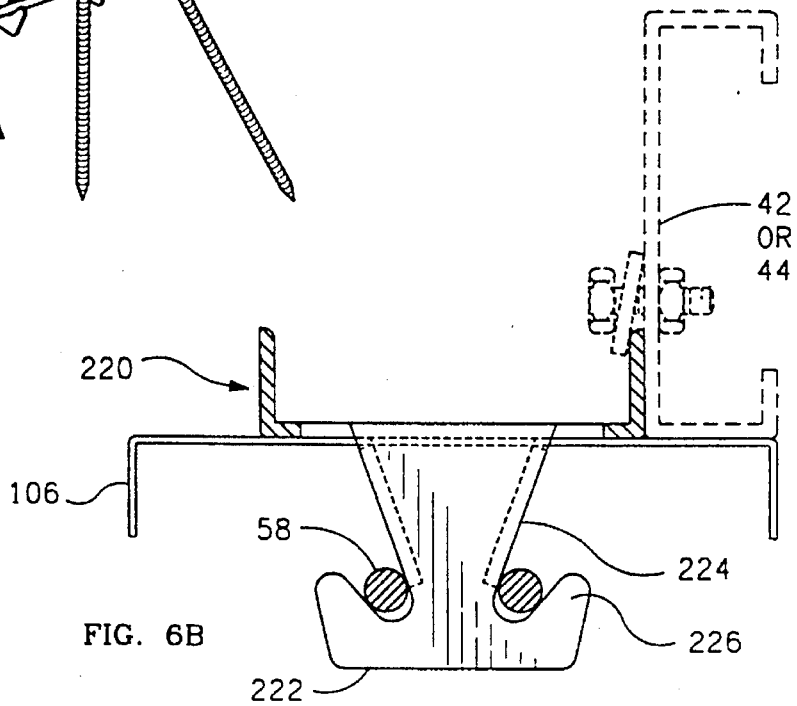

Joist/forms 42 are on each side of a perimeter wall for concrete forming, and generally switch to become floor joists after concrete placement (FIG. 2). Joists/forms 42 and girder elements 44 that were already in the plane of the floor framing stay put permanently. A surface made of a plurality of insulating deck panel 160 may be constructed at any time after.

Joist/forms 42 (FIG. 3) and girder elements 44 are initially connected to either post 46, or clip 48, at corners, with plastic over center collocator 144, which acts to pull tight on diagonal tie 62. This squares up corners of module 40. After module 40 is built on top of a pair of track 86, it is bolted to adjacent module 40 with link plate 50. Module 40 connects to post 46 defining the outer face of the perimeter wall with cantilever plate 52. Modules 40 along the bay with tracks would usually be assembled first.

For most modules, post 46 elements at the interior are initially supported at the proper elevation by adjustable support 116. Post 46 lower ends are ultimately cast into the concrete footing at this location. A threaded stud 216 fastens at a hole for shear transfer to the concrete footing. Column form 60 is slipped over post 46 assemblage, and is filled with concrete up to the underside of floor framing at the same time footing concrete is placed. Post 46 and column form 60 may be added at a location along pairs of girder element 44 where support is needed. This connection may be made at standard holes which are for a joist/form 42 clip 48, or at specially placed holes in girder elements 44 or joist/forms 42.

Elements of threaded stake support assembly 70 (FIG. 4) are all connected to threaded stake 72. Threaded stake 72 is screwed directly into the earth, tapered end first. Nut 74 is then set to desired elevation, established by a water level or laser level. A pair of clamping bar 78 is inserted over threaded stake 72 to accept track 86 at a punchout 87. Other types of track members, described below, may attach here instead. Upper nut 74 is tightened, as a pair of forked wedge 80 is adjusted to level track 86 transversely, and to fit clamping bars 78 to track 86 longitudinally. Punchout 87 which is larger than industry standard, is necessary to provide for variation in threaded stake 72 location when track 86 must be located exactly. The assumption is that threaded stake 72 will never be exactly plumb. Where exact location is not required, then a version of track 86' with industry standard punchouts is used.

Lateral support is given as necessary by threaded stake 72 driven at an angle to intersect another threaded stake 72 at kicker plate 82. It is clamped between pairs of nuts 74. Coupler 84 may be used as required to extend threaded stakes 72.

Joist/form 42 (FIG. 5) generally forms concrete once, then switches to become a floor joist. Alternatively, joist/form 42 may be reused as a form any number of times. Girder element 44 is used to form a concrete surface only when it happens to be permanently pre-placed adjacent to one.

Where it is desirable to cast a framed wall sill track in place with in situ concrete, cast track 220 (FIG. 6) is used. When cast track 220 is be used with version A1 of method outline, stiffening lip 224 of anchoring tab 222 provides a means of securing cast track 220 to tie 106, which is then attached to joist/form 42.

When cast track 220 is used with version B1 of method outline, support and collocation is provided directly at any punchout 87 by threaded stake support assembly 70, combined with any intersecting member of cast track. Cast track 220 then provides collocation of foundation wall surfaces.

Over-center collocator 144 provides a means of temporary connection at module 40 corner. Stud element 148 (FIG. 7) of each half 146 of collocator 144 is inserted into the roughly aligned holes of either joist/form 42, or girder element 44; and a mutually overlapping corner element, which is either post 46, or clip 48. For beginning module 40', a terminal eye of diagonal tie 62 is slipped onto a mating half 146, and forked wedge 80 is slipped under the corresponding other half. Each mating half 146 is then rotated from a roughly upward direction toward the corner of the module 40'. As they rotate toward each other, an engagement end 152 mates the respective other, by presence of an alignment tab 156 and an alignment recess 158.

Diagonal tie 62, which is the second one to be placed in a module 40', and is already secured at the far end, will reach maximum tension when collocator 144 is horizontal. Forked wedge 80 is of a dimension to allow the device to rotate just enough over horizontal to be secure. For non-beginning modules 40, over center collocator 144 is used without diagonal tie 62, nor forked wedge 80, because squaring of those modules 40 is not necessary.

An adjacent piece, such as link plate 50 or cantilever plate 52, may be temporary collocated and connected by collocator 144 stud element 148 which projects beyond outer face of module 40. These projected ends extending from adjacent, interconnected modules 40 provide this connection means.

Connecting cap 92 (FIG. 8) is a callocation and connection means for securing an end of joist/form member 42, while it is held in position for forming the outside of a concrete foundation wall. Joist/form 42 is initially slid over an end of connecting cap 92 at an angle which allows joist/form 42 to clear a pair of stud element 94, while starting the insertion of pressure lip 96 inside each of joist/form stiffening lip 99. Sloped flange 95, combined with elastic deformation of sheet metal, allows this action. Joist/form is then aligned and slid over connecting cap 92 until each stud element 94 snaps flush into corresponding joist/form hole. Pressure lip 96 maintains spring action pressure against stiffening lip 99 of joist/form, keeping stud 94 firmly in hole. Flush face element 100 fills in clearance margins of each joist/form end. Alignment pin 66 further secures connection, and provides collocation with a pair of post 46.

Release of joist/form 42 from connecting cap 92 requires a prying tool 218 to be inserted between each of these pieces. Initially the inserted end of prying tool 218 wedges joist/form material free of each stud element 94, and then prying action is used to move joist/form hole off alignment with each stud element. Joist/form 42 may then be pulled clear.

Omega clip 102 (FIG. 9) secures joist/forms 42 to posts 46 which will remain with the structure. Omega clip 102 slips over post flanges and presses spring flange 103 against backside of joist/form face. A pair of collocating tab 104 provide vertical support at the upper flange of joist/form 42. Alignment pin 66 collocates connection to posts 46. At some locations this connection may also utilize link plate 50 which is cast in the concrete with a pair of bolts.

A pair of link plate 50 nest (FIG. 10A) at grid intersections to collocate adjacent modules 40, with bolted connections all in the same elevation. Two pairs of link plates 50 are ultimately used at each interior intersection, but one pair in combination with collocator 144 (FIG. 7) is generally used before concrete is placed. Link plate 50 may be secured, temporarily, by collocator 144, or permanently, by a bolt.

Cantilever plate 52 (FIG. 10B) is for collocating perimeter forms. Pairs of cantilever plate 52 intersect at a perimeter corner and may be held with over center collocator 144 (FIG. 7), or with bolts. Cantilever plate 52 removes after concrete is formed.

Figure 10A:
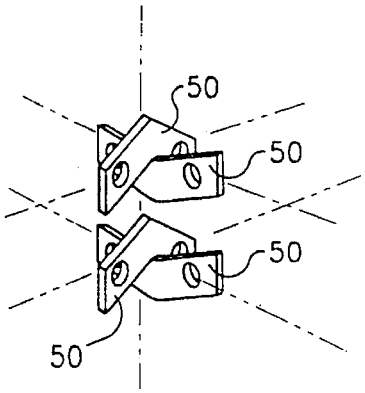
Figure 10B:
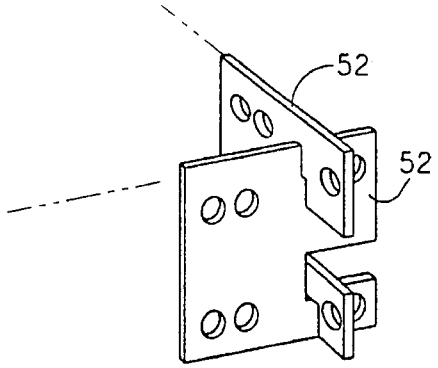
Figure 10C:
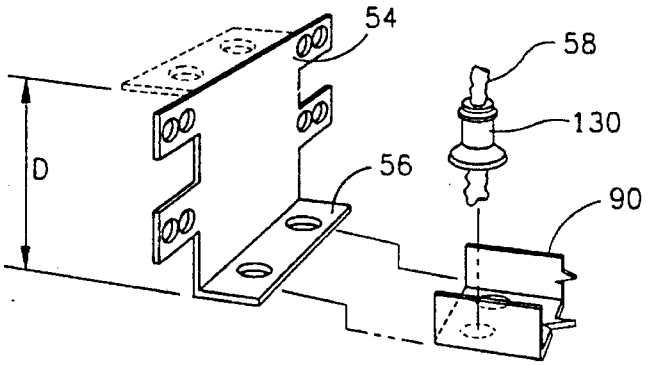
Figure 10D:
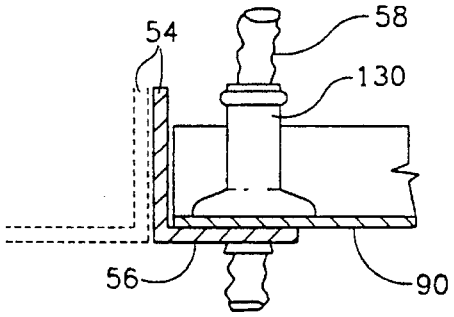
Figure 13B:
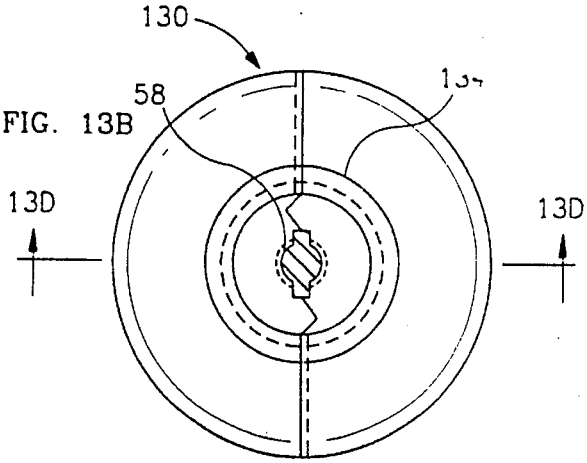
Figure 13C:
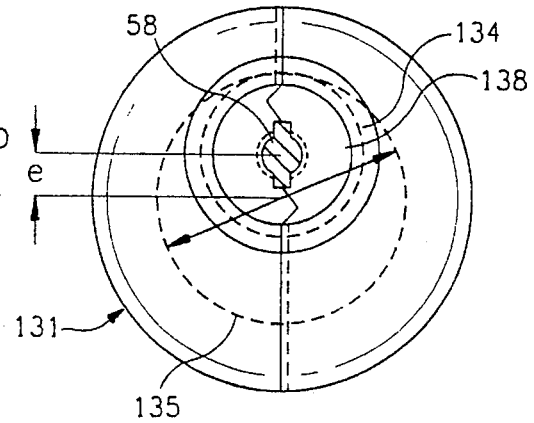
Figure 13D:
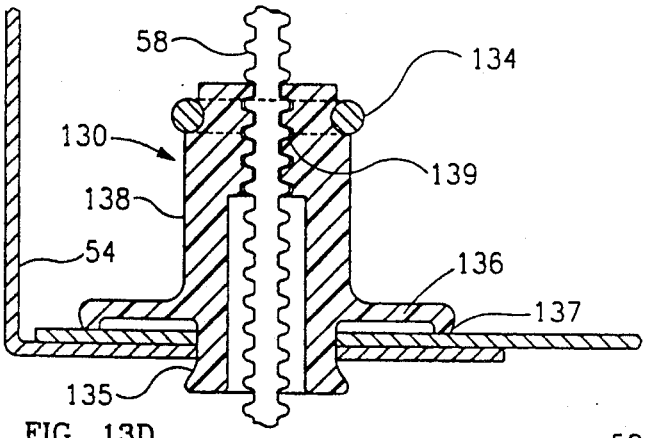
Figure 13A:
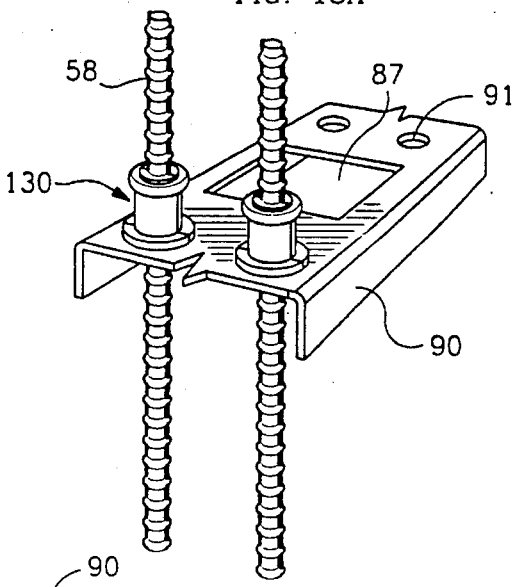
Figure 13E:
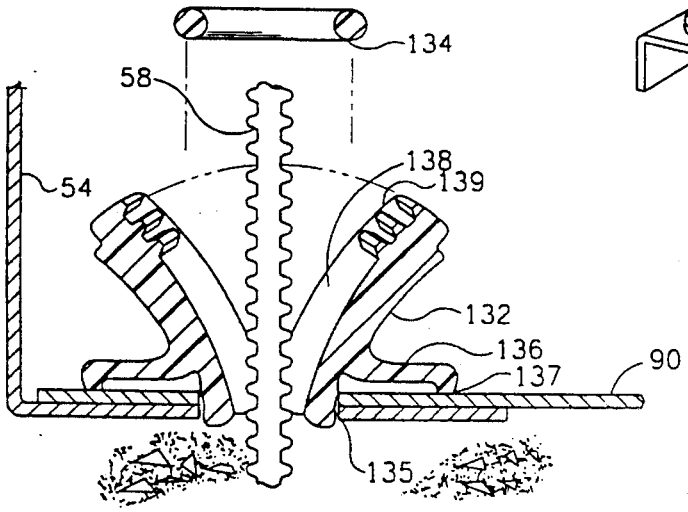
Figure 14A:
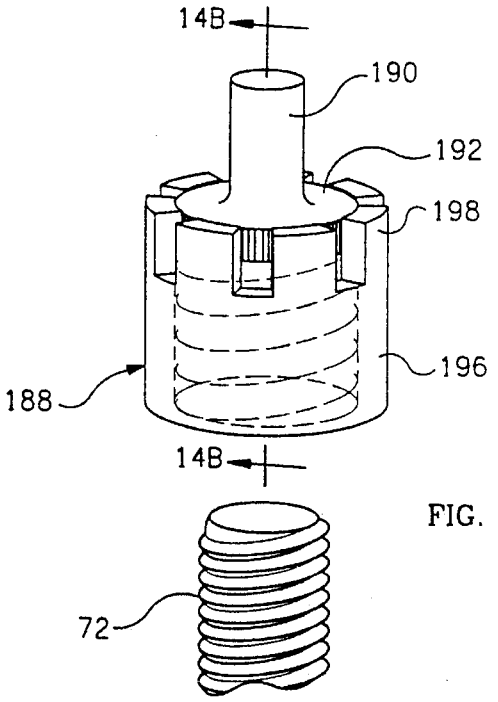
Figure 14B:
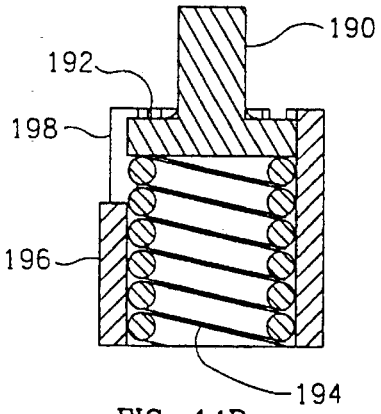
Figure 15A:
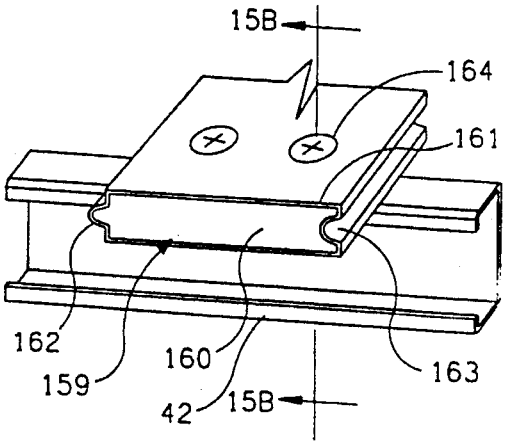
Figure 15B:
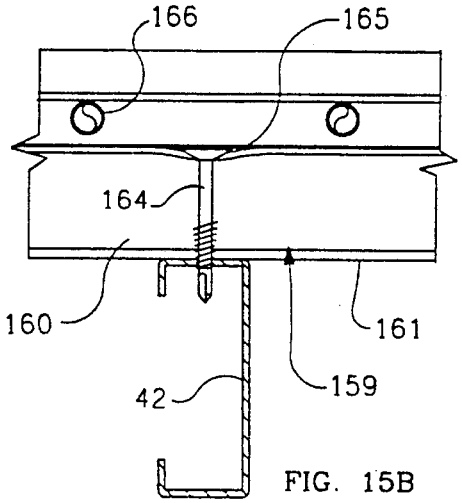
Figure 16A:
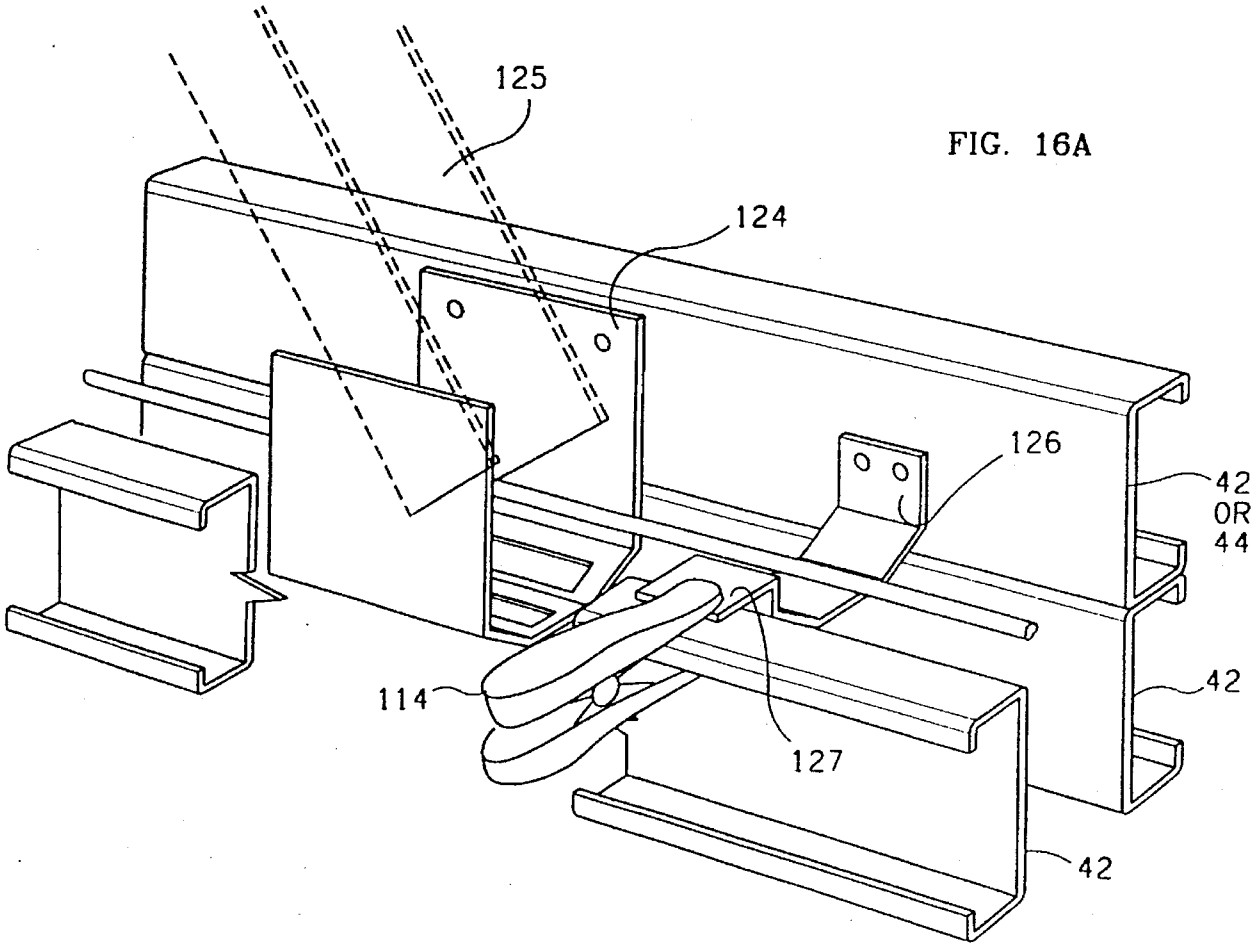
Figure 16B:
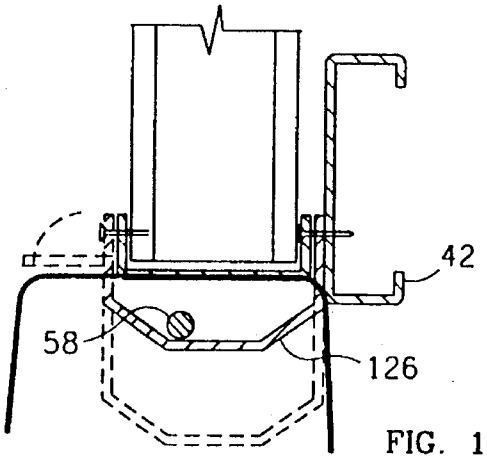
Figure 17:
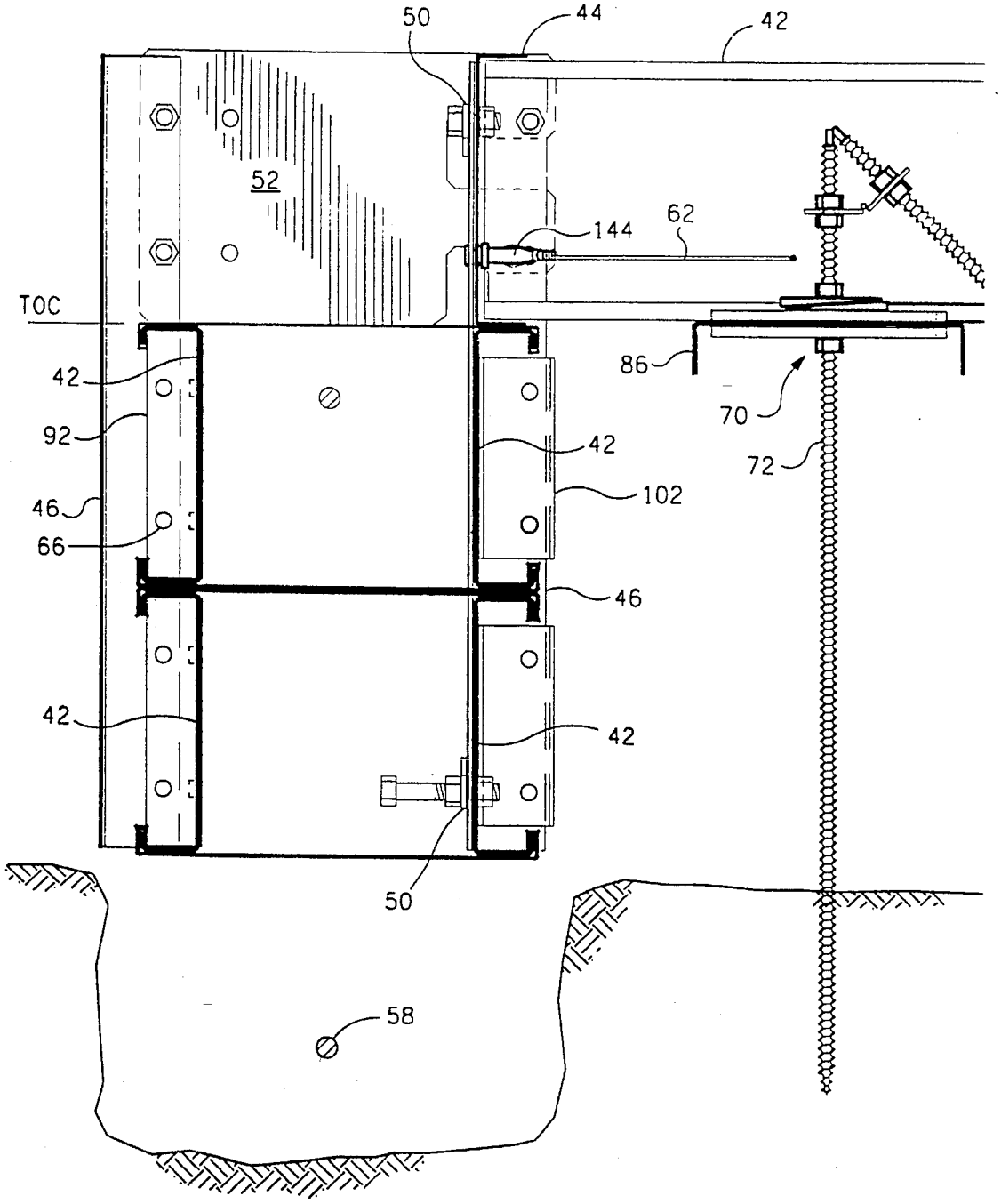
Figure 18:
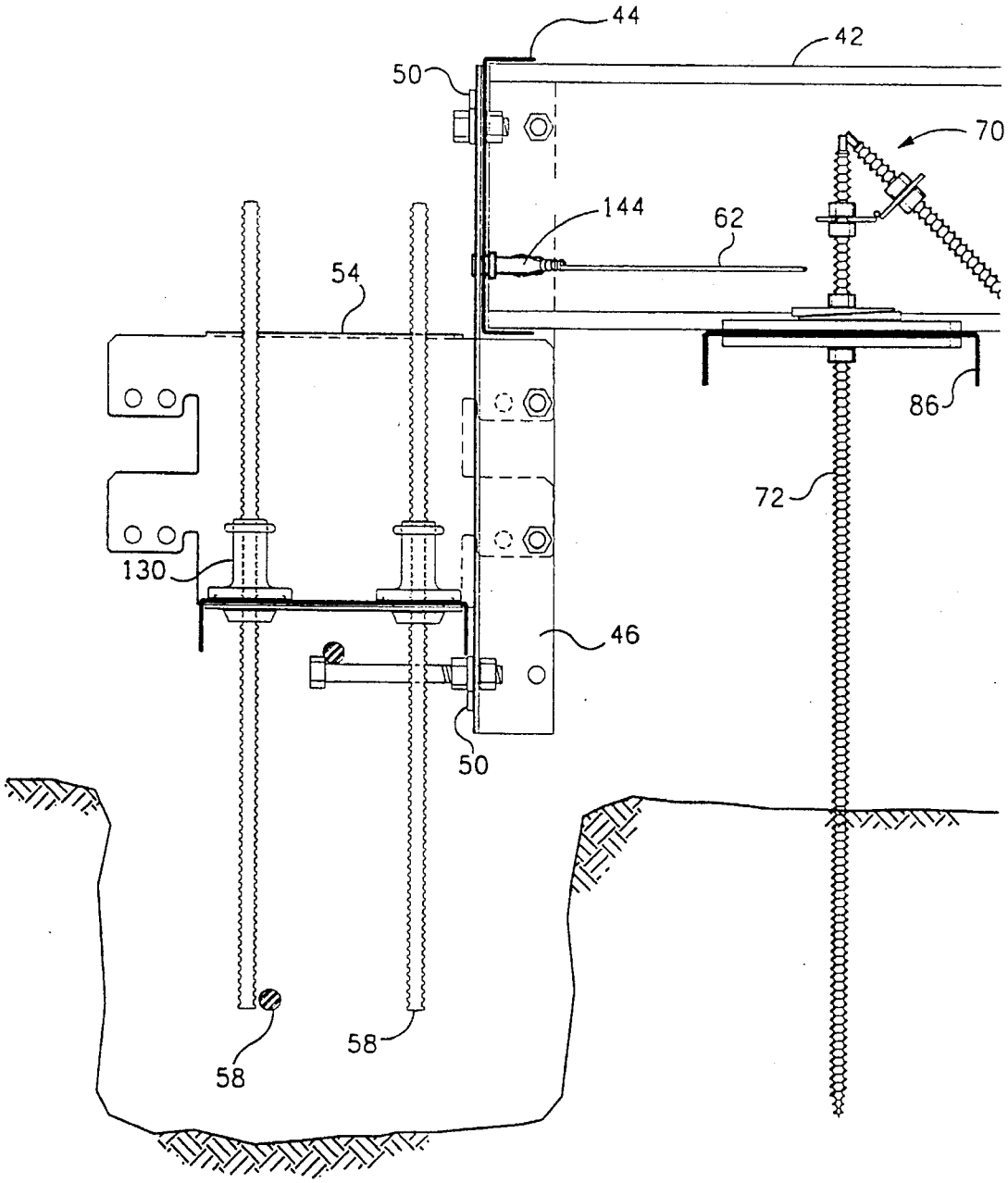
Figure 19:
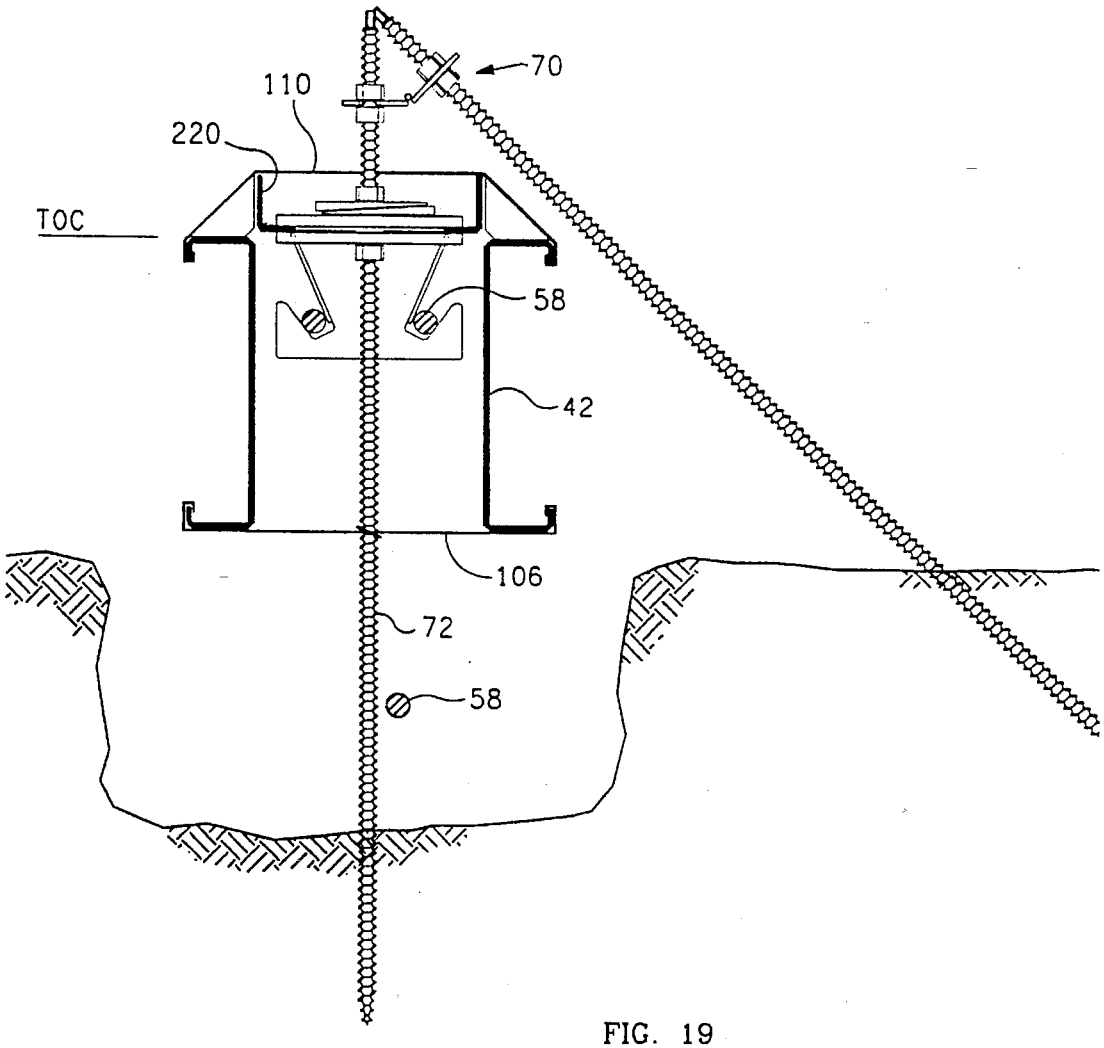
Figure 20:
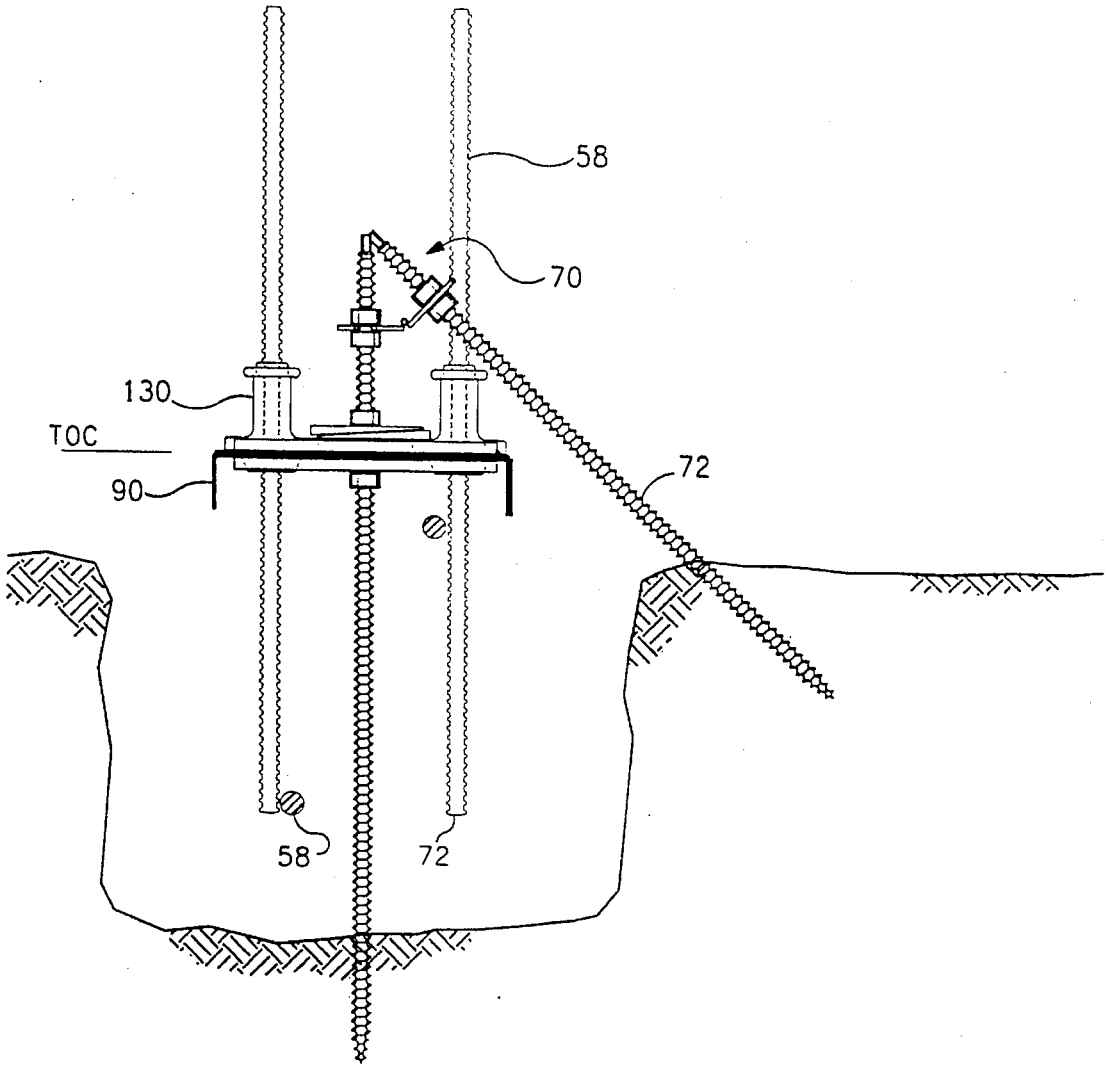
Figure 1:
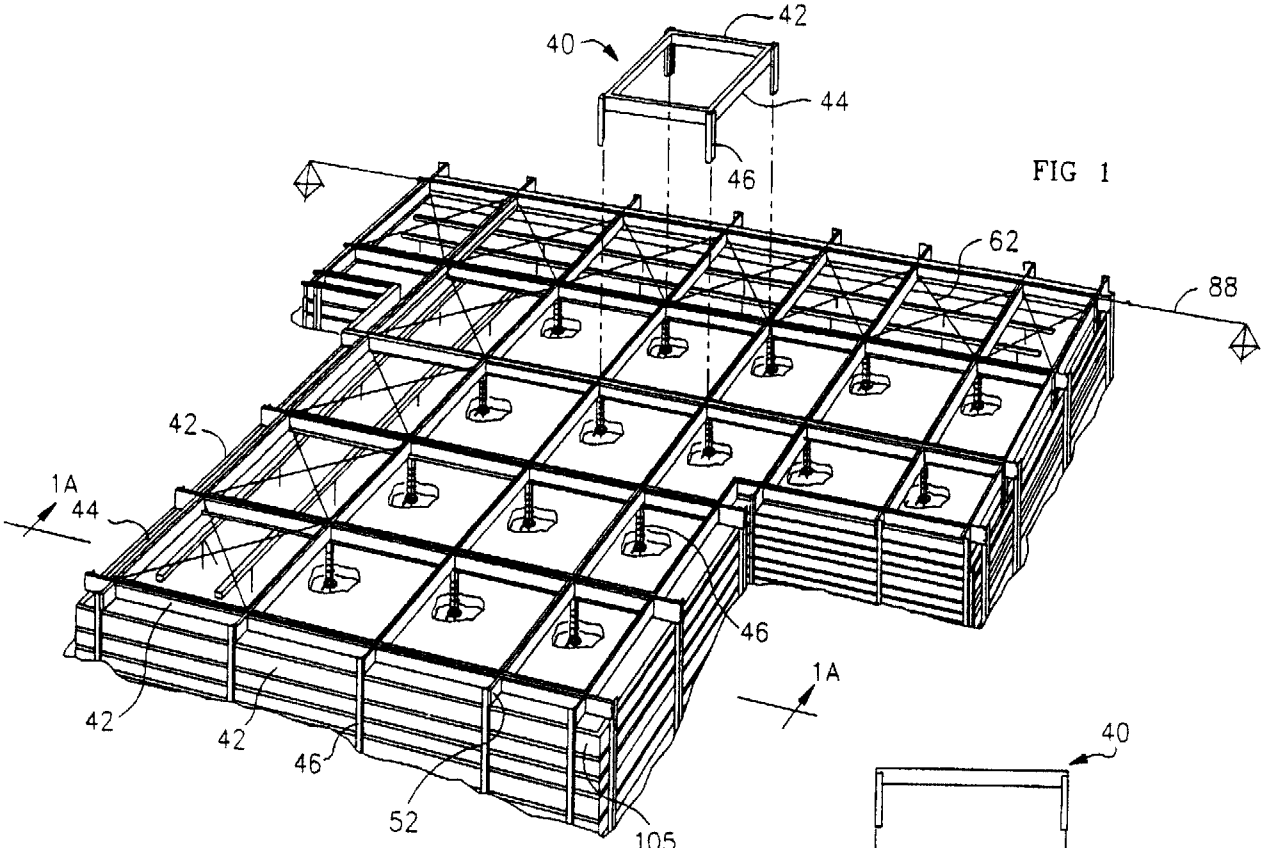
Figure 1A:
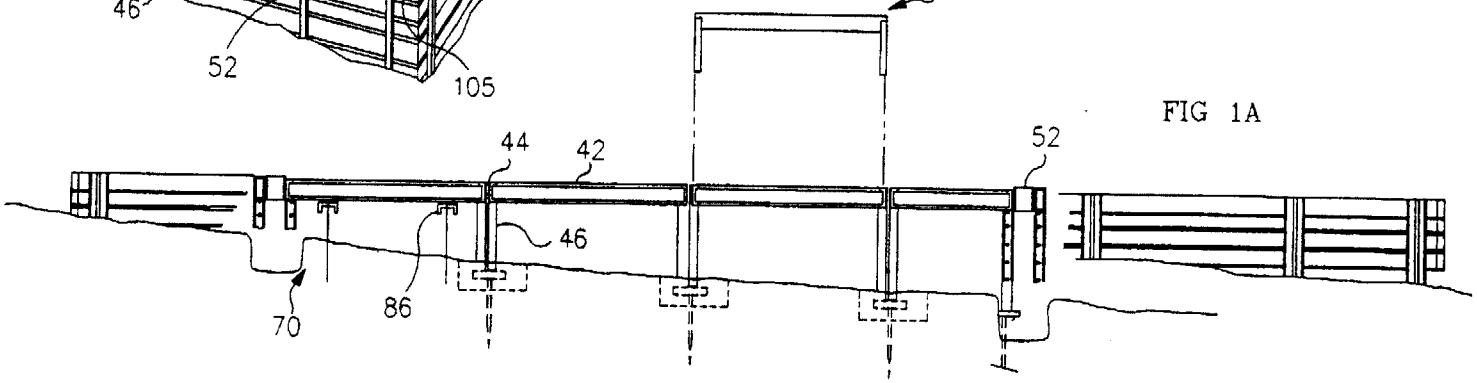
Figure 2:
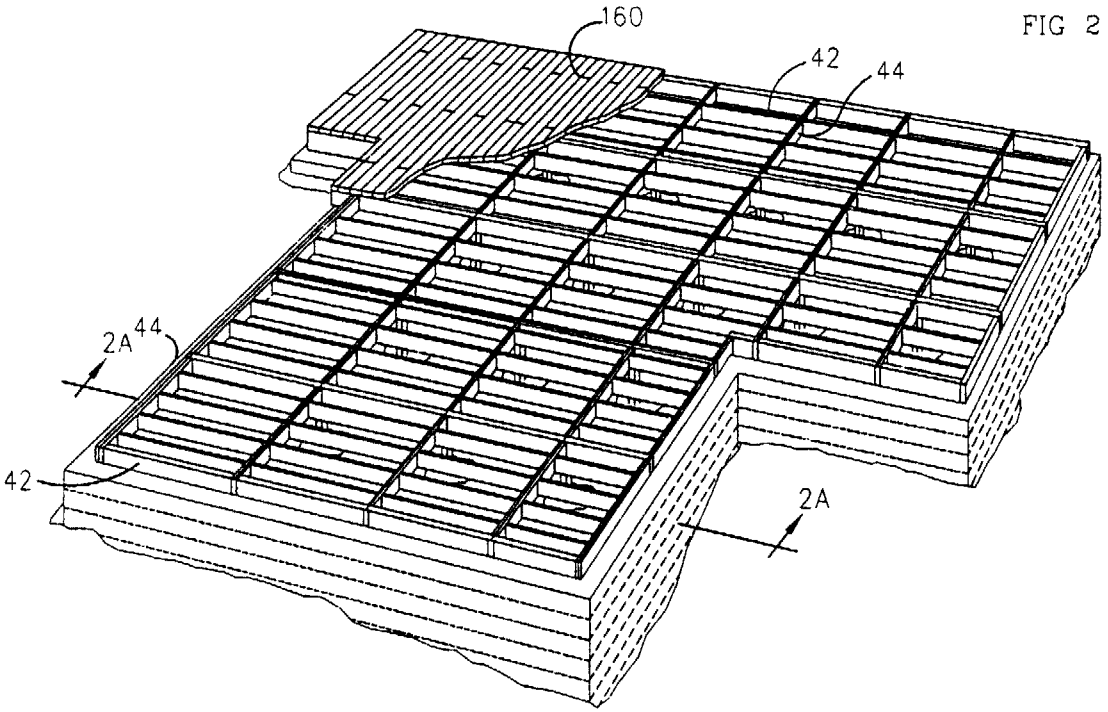
Figure 2A:
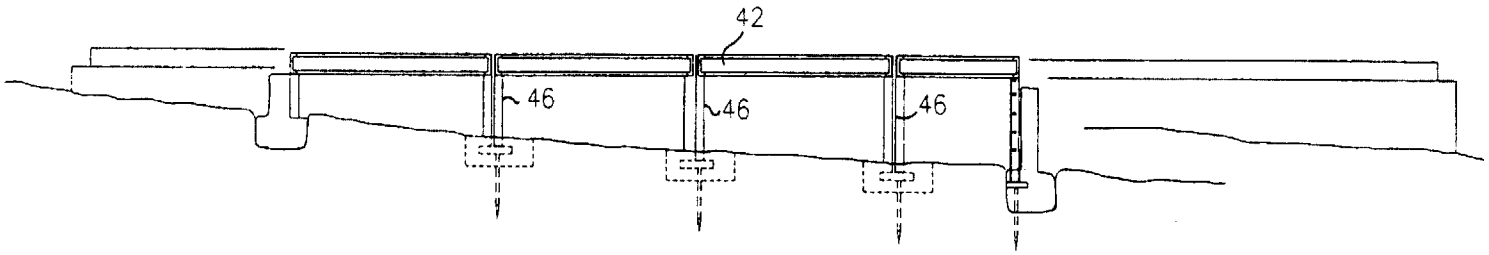
Figure 5:
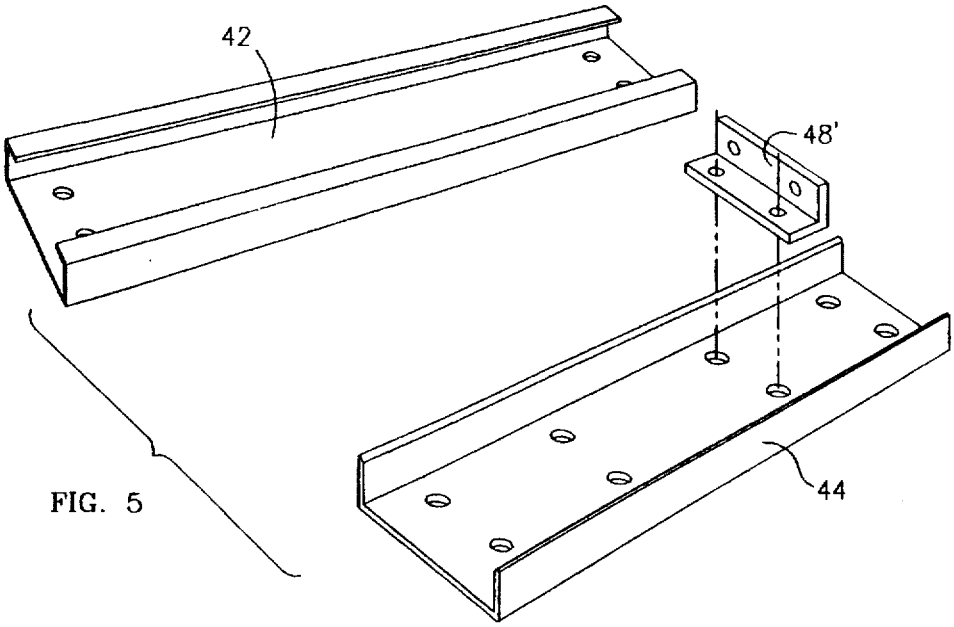
Figure 6A:
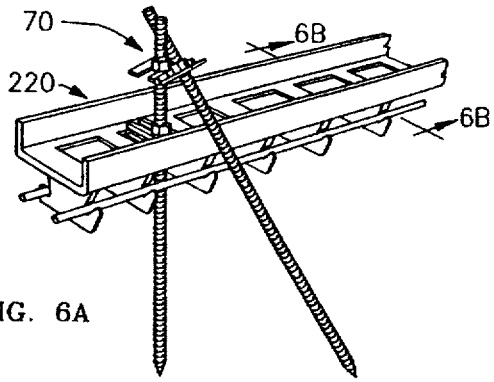
Figure 6B:
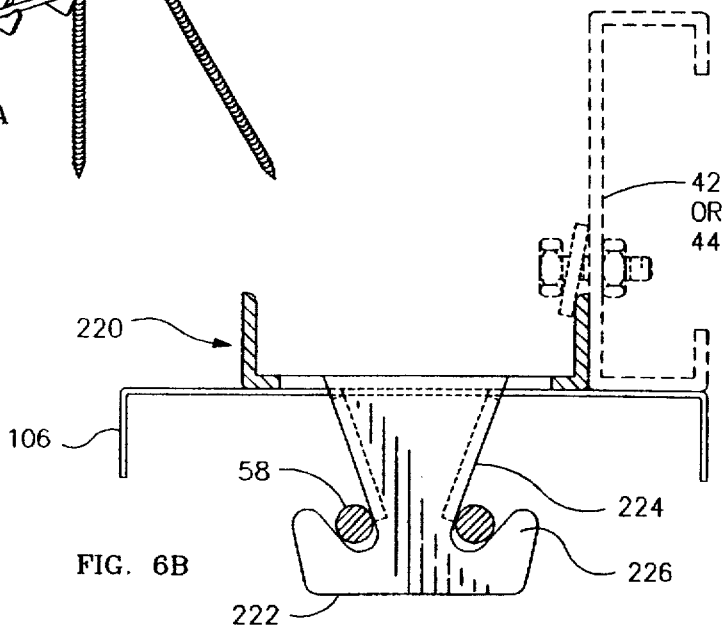

Ledge plate 54 FIGS. 10C–10D is for collocating perimeter forms where concrete type material walls continue on up above floor, as in version A2 of method outline. A pair of ledge plate 54 intersect at a corner identically in method to that of cantilever plate 52. Ledge plate 54 has a ledge 56 for support of a guide track 90. Holes in ledge 56 collocate guide track 90, with means of affixation being a rebar plug 130. Ledge plates 54 are most often used back to back. Ledge plate 54 may have two ledges 56, one at the top which opposes one at the bottom, for steps in the foundation wall. They remove after concrete is placed.

For version B of method outline, hang tie 110 (FIG. 11) is used to secure joist/forms 42 to collocating track, be it guide track 90 or cast track 220. A pair of a hang tie hook 111 grabs stiffening flanges of joist/forms 99. Squaring tab 112, punched and folded out of hang tie 110 body, provides alignment of joist/forms 42.

Form tie 106 is placed against and between joist/forms 42 as necessary for resisting concrete fluid pressure. It may be secured by a pair of a spring clamp 114, which pinch against edges of adjacent joist/form 42 stiffening lips 99. Spring clamp 114 used in this manner also provides support for lower courses of joist/forms 42. Form tie 106 may be secured to threaded stake 72 to help align joist/forms (for version B of method outline).

For use of adjustable support 116 (FIG. 12), threaded stake 72 is screwed into earth approximately below a grid intersection location. Adjustable support 116 is then screwed onto threaded stake 72, and adjusted to a modular distance below floor plane, as determined by a saw cut midway between post 46 connection holes. Any type of a story pole in conjunction with a laser or water level may be used for this elevation setting process. The slight convexity of adjustable support 116 top assists in keeping the high point nearer to grid intersection for instances where threaded stake 72 is not set very plumb. Post 46 is cut to that distance, and sets onto adjustable support 116 as the assembly of modules 70 requires. Adjustable support 116 is restrained from rotating out of adjustment by use of an adjustable plastic loop element comprising tie 120. Tie 120 also prevents uplift of structure during concrete placement. For this application, threaded stake 72 may be of a hard reinforced plastic, rather than steel.

Integral adjustable support 117 has the same operation as adjustable support 116, except that it screws directly in earth.

Either reinforcing bar 58 or a threaded stud 216 may be inserted into post 46 hole for shear transfer of column forces to concrete footing, as required, and may be used to secure column form 60.

Each half 132 of rebar plug 130 (FIG. 13) fits to the other around reinforcing bar 58. The two halves are held together by locking ring 134 which is slipped over the top of rebar plug 130, providing a hold onto reinforcing bar 58. A lower projection 135 of this assembly is then inserted into a hole in guide track 90. Rebar plug 130 may be used simply to affix reinforcing bars 58 to guide track 90, or to also affix guide track 90 to ledge plate 54, or to also splice guide track 90 pieces.

Guide track 90 has a series of punchouts 87 for concrete placement and inspection, and of a hole 91 for reinforcing bar collocation. Collocation and affixation is identical to the methods described for cast track 220. When in place, guide track 90, then defines a foundation wall which will have a concrete type material wall above. It may be left in place, or removed after foundation concrete placement. Superimposed wall surfaces are thereby defined by guide track 90, or by foundation wall surfaces as previously defined by it.

Release of rebar plug 130 after concrete placement, is done by lifting off locking ring 134, and then pulling an upper body 138 of one half 132 away from reinforcing bar 58 so that a surface having some of rib 139 clears reinforcing bar 58. Rebar plug half 132 is then popped free of guide track 90 and concrete. After all rebar plugs 130 are removed, guide track 90 may be removed.

Twister 188 (FIG. 14) is attached to a motor with a shaft 190. It is engaged to threaded stake 72 which does not have a hex head, by turning twister 188 clockwise down threaded stake 72 threads until threaded stake end stops against bottom of a shaft flange 192. Threaded stake 72 may then be driven into earth. Reversing the motor disengages twister 188.

To remove threaded stake 72, twister 188 is first engaged. Then, a twist cover 196, which is attached to the bottom of a wire coil 194, is manually twisted clockwise, or held from rotating while the motor is turned counterclockwise. Wire coil 194 is thereby tightened around threaded stake 72. Threaded stake 72 is then loosened by rotating twist cover 196 counterclockwise.

Insulating deck panel 160 (FIG. 15) may be fastened over joist/forms 42 at any time after floor framing is completed. Tongue edge 162 is inserted into groove edge 163 as panels are set down. Butt ends are staggered. Fastener 164 secures panel 160 to floor framing. A thin concrete floor slab with heat pipes 166 may be placed anytime after.

Shear anchor 126 (FIG. 16) is a fold sheet metal part which cradles subsequently placed wall framing sill track used with version A1 of method outline. It is secured by screwing it permanently against a perimeter floor framing member 230, be it joist/form 42 or girder element 44, before any concrete is placed. An outer leg 127 may also be held fast by a spring clamp 114, and is subsequently bent upward to fasten to wall framing.

Gusset anchor 124 is a folded sheet metal part secured by screwing it permanently against a perimeter floor framing member, be it joist/form 42 or girder element 44, before any concrete is placed. Gusset anchor 124 is located to directly accept a subsequent brace tie 125 pair which is required for lateral loads to structure above.

Sections of the perimeter of the four basic versions of method outline: A1, A2, B1 and B2; are shown (FIGS. 17, 18, 19 and 20 respectively) as they appear just prior to concrete placement.

Building contractors require flexibility in solving construction problems. This means of foundation construction is a comprehensive assemblage of interconnecting parts, which deploy in alternate ways to suit the needs of a given project. Some deployments are not described here.

This method allows a foundation structure of standardized, quickly connecting parts to provide almost effortless accommodation to architectural requirements, because of the active role of computer software.

The cost savings of this foundation construction means will allow first time home ownership for more people.

I claim:

1. A system for constructing a permanent foundation and floor structure from standardized parts and in situ concrete, the system comprising:

a plurality of structural members interconnected and forming a biaxial permanent structural grid;

a plurality of temporary stake supports positioned upon the variable surface of the earth so as to support the permanent structural grid horizontally in a position above the surface of the earth;

a plurality of permanent posts affixed by simple assembly to the permanent structural grid in positions between the permanent structural grid and the earth; and a plurality of planar members that are affixed to the permanent structural grid in positions hanging between said permanent structural grid and the earth, distinctly located and spaced-parallel vertical planes defined between spaced-parallel pairs of the planar members at a periphery of the permanent structural grid, all by simple assembly to the permanent structural grid;

wherein all the plurality of structural members, the plurality of temporary stake supports, the plurality of permanent posts, and the plurality of planar members assemble to each other and are affixed in place before any permanent supporting foundation of in situ concrete is created;

wherein when in situ concrete is poured then the planar members serve as a form defining surfaces of a foundation wall of in situ concrete, which foundation wall is at the periphery of the permanent structural grid;

wherein at least some of said plurality of planar members have a capacity to be removed after hardening of any in situ poured concrete and to subsequently be used elsewhere as a permanent floor joist in said permanent foundation and floor structure, without modification;

wherein in situ concrete is able to anchor the permanent structural grid to which the plurality of permanent posts are affixed to the earth, thus according permanent support to any horizontal floor structure atop the permanent structural grid.

2. The system according to claim 1 further comprising:

a plurality of planar elements, each of which serves to collocate one of the plurality of pairs of planar members, one planar member of the pair serving to define an outer perimeter of a foundation wall relative to said permanent structural grid.

3. The system according to claim 1 further comprising;

a plurality of a planar elements, each having and defining a bend, each of which serves to collocate one of the plurality of planar members, the one planar member defines an outer perimeter of a foundation wall with said permanent structural grid, and provides a ledge for support and for collocation of any structural elements to in the future be located adjacent to subsequently cast concrete.

4. The system according to claim 1 further comprising:

a plurality of elongate angle member each having a plurality of connection holes at regular intervals along a length of said angle member which provides vertical location and support of said permanent structural grid, and connection to any subsequently poured in situ concrete;

wherein the plurality of elongate angle members are supported in their positions by the plurality of temporary stake supports.

5. The system according to claim 1 further comprising:

a plurality of part means, each for providing a connection to a face of a one of the plurality of planar members that is utilized in forming a surface of in situ concrete, the part means providing a virtually flush condition for said surface in vicinity of said connection.

6. The system according to claim 1 further comprising:

a plurality of part means each for providing a connection to a one of the plurality of planar members that is used for forming a surface of concrete, each part means aligning and affixing said one planar member coincident to said permanent structural grid, and permitting said one planar member to subsequently be utilized elsewhere as a floor joist, without modification.

7. The system according to claim 1 further comprising:

a plurality of linear reinforcing elements that are able to be cast into and extend out of any in situ concrete; and a thin walled channel member for coilocating the plurality of linear reinforcing elements, the thin walled channel member having a plurality of large holes that provide access to a cavity into which said concrete is able to be subsequently poured, and the thin walled member being utilized as a collocation device which defines a surface of any said concrete.

8. The system according to claim 1 wherein the plurality of temporary stake supports comprise:

a plurality of rods each having a continuous thread that is screwed into the earth; and a plurality of support devices each of which threads onto a one of the plurality of rods to provide vertical collocation of said permanent structural grid, each support device having and defining a broad upper surface with a plurality of a holes.

9. The system according to claim 1, wherein each of the plurality of permanent posts comprises:

a vertical support member connected at its top end to said structural grid;

a support device connected between the bottom end of said vertical support member and the earth that screws directly into the earth and provides vertical collocation of said vertical support member and of said permanent structural grid, the support device having and defining a broad upper surface with a plurality of holes; and an adjustable loop element connected to and used with the support device that restrains rotation of said support device, prevents unwanted adjustment, and affixes said permanent structural grid.

10. The system according to claim 1 further comprising:

a permanent structural framing member; and a folded sheet metal part that is held in place by and adjacent to the permanent structural framing member, a permanent connection of said part being made to said structural member and cast with in situ concrete subsequent to said permanent connection, the part having a configuration which cradles a bottom of a wall framing assembly, which has and defines relatively large holes providing continuity of said in situ concrete, and which provides transfer of wind and seismic forces from a structure to a foundation.

11. The system according to claim 1 further comprising:

a plurality of column forms surrounding and containing the plurality of permanent post;

wherein each of the plurality of column forms is affixed in place with all the plurality of structural members, the plurality of temporary stake supports, the plurality of permanent posts, and the plurality of planar members before any permanent supporting foundation of in situ concrete is created;

wherein any in-situ concrete poured into the plurality of column forms and around the plurality of permanent posts that are within the plurality of column forms serves to anchor the plurality of permanent posts, and also the permanent structural grid to which the plurality of permanent posts are affixed, to the earth, thus according permanent support to any horizontal floor structure atop the permanent grid.

12. The system according to claim 1 further comprising:

a forming device for in situ concrete, the device emplaced about a one of the plurality of permanent posts, the device including a cylindrical membrane flexible enough to provide a capacity to adjust significantly in length, said device having a continuous helical reinforcing element which adjusts in pitch to allow required adjustment in length, the forming device serving to support fluid pressure of any newly placed in situ concrete, and providing permanent structural constraint of a resulting concrete column.

13. The system according to claim 1 further comprising:

a sheet of rigid insulating foam material which provides support for a floor slab, and provides a layer of insulation between a space above, and another space below said sheet, the sheet being placed atop the permanent structural grid and having an adhered structural membrane on each face for flexure and puncture strength, an adhered web element along an edge for transmission of laminar shear between each of said structural membrane, which is made of a continuation of said membrane, and an edge profile which provides alignment of adjacent sheets.

14. An assembling and dis-assembling and re-assembling adjustable support usable with a large number of like supports for supporting a structural grid of a building floor in a level position the irregular un-level surface of the earth, the adjustable support comprising:

two rod elements, each having a continuous thread with one end tapered, each of which screws directly into the earth so as to intersect at a position above the surface of the earth whereat a structural grid of a building floor is desirably supported; and a clamping assemblage having two hinged plates each of which plates mounts a threaded nut that serves as follower to a respective one of the intersecting two threaded rod elements;

wherein adjustment of the two intersecting threaded rod elements and the clamping assemblage threadingly engaging both supports and locates a structure, said assemblage serving to adjust and affix said structure, and having a capacity to be employed at any point along either of said two rod elements.

15. The adjustable support of claim 14 in conjunction with a thin walled structural member that is cast permanently in place with in situ concrete, and subsequently serves as a bottom channel of a framed stud wall, the structural member having and defining a plurality of a large holes that provide access to a cavity into which said concrete is subsequently placed, a plurality of bent tabs which provide anchorage to said concrete,and a plurality of a large holes which provide for an adjustable connection to said adjustable support to collocate said member.

16. The adjustable support of claim 14 in conjunction with:

a thin walled structural element that forms a surface for any in situ concrete;

a collocating structural member comprising a locking ring that fits within an aperture of the thin-walled structural element and threadingly engages a threaded rod element;

wherein the adjustable support provides support to collocate and affix the thin walled structural element against force due to gravity and force of fluid pressure due to any placement of in situ concrete.

17. A dual purpose system for framing a structural foundation, and then, subsequently with at least some of the same parts, providing floor joists for a floor that rests upon the foundation, the dual purpose foundation framing and floor joist system comprising:

a multiplicity of thin-walled structural framing members c-shaped in section, having a face and two of an identical flange, each said flange with a stiffening lip utilized both in construction of a foundation and, later, as a joist to a floor, each thin-walled structural framing member suitably strong to physically define a surface for any in situ concrete and to subsequently serve as a permanent floor joist, without modification, each thin-walled structural framing member having a pair of holes through its face near each end; and collocation and connection means for locating and connecting the thin-walled structural framing members as framing members in their use in construction of a foundation, the collocation and connection means having a connecting cap that inserts within an end of the thin-walled structural framing member by a dimensional fit of said connecting cap into an area bounded between an inner surface of each said stiffening lip, and an inner surface of said face, the connecting cap affixing the thin-walled structural framing member by one or more of a projected stud element, said stud element projecting at a height corresponding to the thickness of said face, which mates one or more of said holes within said face, the connecting cap achieving engagement and release of connection with the thin-walled structural framing member by elastic flexural deformation, the connecting cap providing a virtually flush outer surface of said face in the vicinity of said connection for providing consistent surface areas in the vicinity of and away from said connection to define said surface for any in-situ concrete;

wherein a secure attachment of the thin-walled structural framing member is accomplished.

18. The system of claim 17 wherein each of the multiplicity of thin-walled structural members serving as a framing member has a plurality of pairs of holes along its length that provide collocation for a plurality of the thin-walled structural framing members which connect to said member.

19. A method of constructing upon the earth a unified foundation and a floor, the construction method comprising:

laying out and assembling and supporting level above the surface of the earth upon temporary stake supports a permanent structural grid, all by simple assembly of regular geometric parts;

hanging between the supported structural grid and the earth (i) a plurality of permanent support posts, and, at the periphery of the structural grid, (ii) a plurality of pairs of spaced-parallel substantially planar panels each of which panel pairs define between them a concrete form for a portion of a foundation wall; and then pouring in-situ concrete at the base of the hanging permanent support posts, and also into the foundation wall portion forms so as to form a foundation and so as to permanently affix the structural grid upon the foundation;

wherein, at the conclusion of the pouring of in-situ concrete, a level structural grid that is suitable to support a floor is left supported above the surface of the earth on, and affixed to, both permanent support posts, and also a permanent concrete foundation.

20. The construction method according to claim 19 further comprising:

hanging between the supported structural grid and the earth a plurality of concrete forms circumferentially around the plurality of permanent support posts; and wherein the pouring in-situ concrete is also into the concrete column forms.

21. The construction method according to claim 19 that, after the pouring of the in-situ concrete, further comprises:

removing and reusing the temporary stake supports posts.

22. The construction method according to claim 19 that, after the pouring of the in-situ concrete, further comprises:

removing and reusing at least one panel of the spaced-parallel substantially planar panels that define between them a concrete form for a portion of a foundation wall.

23. The construction method according to claim 22 further comprising:

reusing the at least one removed panel as either panel of a pair of spaced-parallel substantially planar panels.

24. The construction method according to claim 19 that, after the laying out and assembling and supporting, and after the hanging, but before the pouring, further comprises:

affixing a panel of rigid insulating foam material to the top of the permanent structural grid;

and wherein the in-situ pouring of concrete is also over the affixed panel;

wherein the affixed panel of rigid insulating foam material serves as support for a floor slab, and provides a layer of insulation between said floor slab and the permanent structural grid that is supported above, and affixed, to the earth.

25. A unified foundation and floor that, at a one instant of time during its construction, comprises:

a multiplicity of temporary stake supports defining an imaginary level surface above the surface of the earth;

a permanent structural grid laid out and simply assembled from regular geometric parts and supported level above the surface of the earth upon the multiplicity of temporary stake supports;

a multiplicity of permanent support posts hanging between the supported structural grid and the earth;

a multiplicity of pairs of spaced-parallel substantially planar panels, located at the periphery of the structural grid and affixed thereto for hanging between the structural grid and the earth, each of which panel pair define between them a concrete form for a portion of a foundation wall;

wherein in-situ concrete is able to be poured into the foundation wall portion forms so as to form a foundation and at the base of the permanent support posts, then, at the conclusion of the pouring of in-situ concrete, a level structural grid that is suitable to support a floor is left supported above the surface of the earth on, and affixed to, both the permanent support posts, and also a permanent concrete foundation.

26. The unified foundation and floor according to claim 25 further comprising:

a multiplicity of concrete column forms hung between the supported permanent structural ground and the surface of the earth in positions surrounding the multiplicity of hanging permanent support posts;

wherein the in-situ concrete is also able to be poured into the concrete column forms so as to form support columns leaving, at the conclusion of the pouring of in-situ concrete, the level structural grid that is suitable to support a floor supported above the surface of the earth on, and affixed to, permanent concrete columns.

27. The unified foundation and floor according to claim 25 wherein the multiplicity of temporary stake supports are removable and reusable.

28. The unified foundation and floor according to claim 25 wherein at least one panel of the multiplicity of spaced-parallel substantially planar panels that define between them a concrete form for a portion of a foundation wall is removable and reusable.

29. The unified foundation and floor according to claim 25 further comprising:

a panel of rigid insulating foam material affixed to the top of the permanent structural grid;

wherein in-situ concrete is also able to be poured over the affixed panel;

wherein the affixed panel of rigid insulating foam material serves as support for a floor slab of in-situ concrete, and provides a layer of insulation between said concrete floor slab and the permanent structural grid that is supported above, and affixed, to the earth.

* * * * *

UNITED STATES PATENT AND TRADEMARK OFFICE

CERTIFICATE OF CORRECTION

PATENT NO. : 5,564,235

DATED : Oct. 15, 1996

INVENTOR(S) : Michael Butler

It is certified that error appears in the above-identified patent and that said Letters Patent is hereby corrected as shown below:

The title page, showing the illustrative figure should be deleted and substitute therefor the attached title page.

Figure 1A:
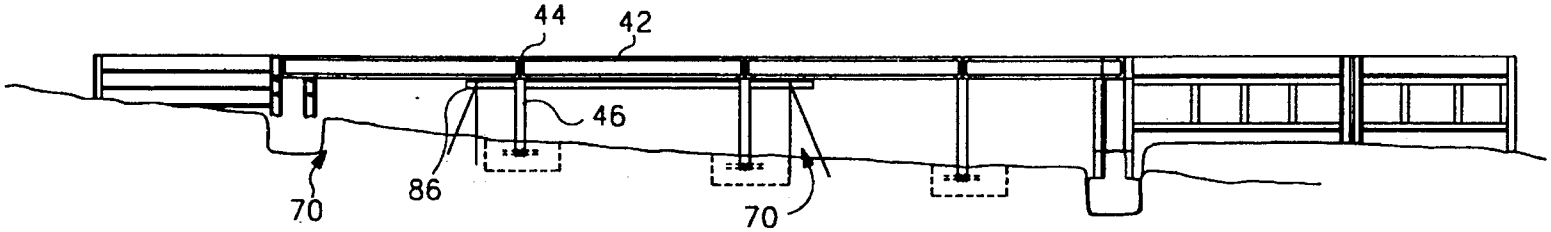

Drawings sheets 1/17; 2/17 and 5/17 respectively containing drawings figures 1,1a; 2, 2a; and 5, 6a, 6b are replaced by the drawings sheets 1/17; 2/17; and 5/17 containing the same figures, attached.

Signed and Sealed this

Twenty-third Day of March, 1999

*Attest:*

Q. TODD DICKINSON

*Attesting Officer*

*Acting Commissioner of Patents and Trademarks*

US005564235A

United States Patent [19]

Butler

[11] Patent Number: 5,564,235

[45] Date of Patent: Oct. 15, 1996

[54] FOUNDATION AND FLOOR CONSTRUCTION MEANS

[76] Inventor: Michael Butler, 31078 Turner Rd., Fort Bragg, Calif. 95437

[21] Appl. No.: 299,474

[22] Filed: Aug. 29, 1994

[51] Int. Cl.[6] ..... E02D 27/00; E04B 5/10; E04B 5/17

[52] U.S. Cl. ..... 52/126.6; 52/263; 52/294; 52/299; 52/650.3; 52/742.14; 249/4; 249/6; 249/18; 249/210; 16/260

[58] Field of Search ..... 52/29, 294, 263, 52/126.6, 650.3; 249/3, 4, 5, 6, 7, 18, 207, 210; 403/300, 301, 303, 311; 16/260, 267, 268, 269, 271, 742.14

[56] References Cited

U.S. PATENT DOCUMENTS

| | | | |
|---|---|---|---|
| 1,576,846 | 3/1926 | Pomfret | 249/210 X |
| 1,897,530 | 2/1933 | Pandolfi | 249/4 |
| 3,826,460 | 7/1974 | Cast | 249/210 X |
| 3,977,536 | 8/1976 | Moore et al. | 249/18 X |
| 4,142,705 | 3/1979 | Miller | 249/210 X |
| 4,202,145 | 5/1980 | Coulter et al. | 52/294 X |
| 4,451,022 | 5/1984 | Sauger | 249/4 X |
| 4,930,278 | 6/1990 | Staresina et al. | 52/602 X |
| 5,343,667 | 9/1994 | Peden | 52/699 |
| 5,402,614 | 4/1995 | Jewell | 52/299 |

FOREIGN PATENT DOCUMENTS

| | | | |
|---|---|---|---|
| 1145179 | 4/1983 | Canada | 249/210 |
| 2829249 | 1/1980 | Germany | 52/263 |
| 6-57761 | 3/1994 | Japan | 52/294 |
| 6-116966 | 4/1994 | Japan | 52/294 |
| 6-180063 | 6/1994 | Japan | 249/18 |
| 293955 | 1/1954 | Switzerland | 52/263 |

OTHER PUBLICATIONS

"Slabmaker I Adjustable Slab on Grade Form System", Medalist Forming Systems Brochure 2 pages, 1986.

dec Steel Forms Advertisment, Concrete Construction, Oct. 1994, p. 818.

Metaforms Advertisment, Concrete Construction, Oct. 1994, p. 822.

*Primary Examiner*—Carl D. Friedman
*Assistant Examiner*—Laura A. Saladino
*Attorney, Agent, or Firm*—William C. Fuess

[57] ABSTRACT

A foundation structure comprises a plurality of light metal parts which assemble and secure in place prior to placement of foundation in situ concrete. Assemblage is supported by coarsely threaded rods which screw directly into earth and attach to parts by various methods. Some parts remain in place as permanent supporting members for superimposed structure. Others, which generally form surfaces of foundation concrete, subsequently relocate to become either similar permanent structural members, or inventory for subsequent projects. Use of a computer aided design program assists in optimal configuration of parts, and creates a list of parts with necessary cut and piecemark information for automated fabrication of any particular length parts. This information, along with a computer produced schematic plan, allows use of parts as collocation elements which define a distinct foundation design by simple field assembly. Variations in assemblage of parts accommodate requirements of site, user needs, and materials of subsequent structure. Specific versions offer an integral joist floor structure, a free standing wall, or a concrete slab on grade. Interface with subsequently superimposed walls is specific to those of either framed members, or concrete type materials.

29 Claims, 17 Drawing Sheets

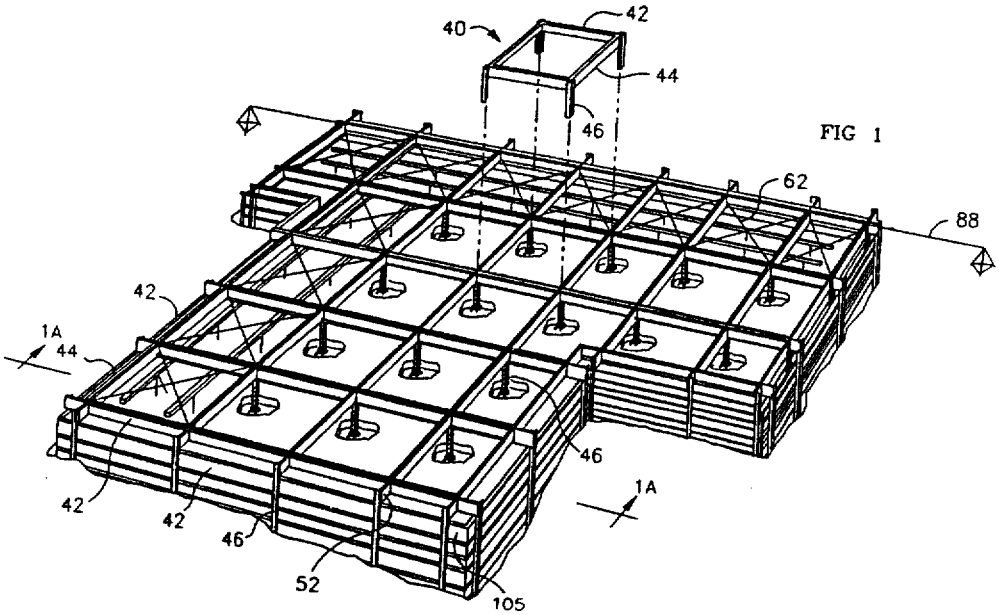

FIG 1